US006189330B1

(12) United States Patent
Retallick et al.

(10) Patent No.: US 6,189,330 B1
(45) Date of Patent: Feb. 20, 2001

(54) CONTAINER, SYSTEM AND PROCESS FOR SHIPPING AND STORING FOOD PRODUCTS AND METHOD FOR RECYCLING SHIPPING AND STORAGE CONTAINERS

(75) Inventors: Donna L. Retallick, Cherry Hill, NJ (US); Kelly M. Maher, Philadelphia, PA (US)

(73) Assignee: Campbell Soup Company, Camden, NJ (US)

( * ) Notice: Under 35 U.S.C. 154(b), the term of this patent shall be extended for 0 days.

(21) Appl. No.: 09/225,494

(22) Filed: Jan. 6, 1999

Related U.S. Application Data

(60) Provisional application No. 60/070,563, filed on Jan. 6, 1998, and provisional application No. 60/072,169, filed on Jan. 7, 1998.

(51) Int. Cl.[7] ..... F25D 3/08; B65D 21/02

(52) U.S. Cl. ..... 62/371; 62/457.7; 220/23.88

(58) Field of Search ..... 62/457.7, 371; 220/23.83, 23.86, 23.88, 555, 592.03

(56) References Cited

U.S. PATENT DOCUMENTS

| | | | |
|---|---|---|---|
| 910,576 | 1/1909 | Randall . | |
| 1,405,002 | 1/1922 | Rhodes . | |
| 1,570,533 | 1/1926 | Styll . | |
| 2,132,956 | 10/1938 | Kiechkhefer . | |
| 2,229,223 | 9/1941 | Rhodes . | |
| 2,341,845 | 2/1944 | Mark et al. . | |
| 2,367,520 | 1/1945 | Patek . | |
| 3,015,197 | 1/1962 | Eichorn . | |
| 3,416,648 | 12/1968 | Levi . | |
| 3,421,679 | 1/1969 | Goldman . | |
| 3,463,343 | 8/1969 | Asenbauer . | |
| 3,531,040 | 9/1970 | Myny . | |
| 3,564,811 | 2/1971 | Freeman . | |
| 3,565,243 | 2/1971 | Freeman . | |
| 3,701,465 | 10/1972 | Richter . | |
| 3,750,781 | 8/1973 | Lengsfeld . | |
| 3,750,871 | 8/1973 | Cook . | |
| 3,791,547 * | 2/1974 | Branscum | 62/371 X |
| 3,890,762 | 6/1975 | Ernst et al. . | |
| 3,973,720 | 8/1976 | Schmid . | |
| 4,042,108 | 8/1977 | Brethauer . | |
| 4,046,311 | 9/1977 | Voytko . | |
| 4,069,938 | 1/1978 | Palte et al. . | |
| 4,122,946 | 10/1978 | Holley . | |
| 4,160,503 | 7/1979 | Ohlbach . | |
| 4,173,286 | 11/1979 | Stanko . | |
| 4,213,310 * | 7/1980 | Buss | 62/457 |
| 4,461,395 | 7/1984 | Burnett . | |
| 4,468,913 | 9/1984 | Guillon et al. . | |
| 4,497,859 | 2/1985 | Baumann . | |
| 4,498,598 | 2/1985 | Bae . | |
| 4,509,656 | 4/1985 | Rösler . | |
| 4,535,929 | 8/1985 | Sherman, II et al. . | |
| 4,602,715 | 7/1986 | Sarver et al. . | |
| 4,709,817 | 12/1987 | Keady et al. . | |
| 4,714,196 | 12/1987 | Keenan et al. . | |
| 4,724,976 | 2/1988 | Lee . | |
| 4,746,059 | 5/1988 | Jackson . | |
| 4,790,120 | 12/1988 | Manduley et al. . | |
| 4,807,808 | 2/1989 | Reed . | |
| 4,830,190 * | 5/1989 | Inagaki et al. | 62/457.7 X |
| 4,836,379 | 6/1989 | Shaw . | |
| 4,848,062 | 7/1989 | Manduley et al. . | |
| 4,969,312 | 11/1990 | Pivert et al. . | |
| 5,062,527 | 11/1991 | Westerman . | |
| 5,082,115 * | 1/1992 | Hutcheson | 220/23.83 X |
| 5,131,212 | 7/1992 | Grey et al. . | |
| 5,146,732 | 9/1992 | Grey et al. . | |
| 5,247,747 | 9/1993 | Grey et al. . | |
| 5,456,061 | 10/1995 | Grey et al. . | |
| 5,469,691 | 11/1995 | Grey et al. . | |
| 5,639,471 | 6/1997 | Chait et al. . | |
| 5,730,282 * | 3/1998 | Bureau | 220/23.86 X |
| 5,924,303 * | 7/1999 | Hodosh | 62/457.7 X |

OTHER PUBLICATIONS

D.A. McCarron et al., Nutritional Management of Cardiovascular Risk Factors—A Randomized Clinical Trial, 157 Arch. Interns Med. 169–177 (Jan. 27, 1997).

O'Connell, How Campbell Saw a Breakthrough Menu Turn to Leftovers, Wall Street Journal, Oct. 6, 1998, at A1, A12.

C. Barner, Icy Containers, Packaging Digest, May, 1997 at 60, 62.

* cited by examiner

*Primary Examiner*—William Doerrler
*Assistant Examiner*—Chen-Wen Jiang
(74) *Attorney, Agent, or Firm*—Baker Botts L.L.P.

(57) ABSTRACT

A container for shipping and storing food products in two separate chambers has an outer casing enclosing a temperature controlled container fabricated from an insulating material. The temperature controlled container includes a lid and a base. The base has a base chamber including several ventilation channels formed on the interior of the base chamber. The lid has a first side for sealing the base chamber, which also includes several horizontal channels formed in the first side, and a lid chamber divided into several food product receiving chambers. A lip is formed on the base and a corresponding groove is formed on the lid, such that the lip interlocks with the groove for sealing the base chamber. Moreover, dry ice may be positioned within the temperature controlled container with respect to a plurality of food products to control the temperature within the temperature controlled container. In addition, a method for recycling a shipping and storage container includes the steps of providing shipping containers to a provider of individually packaged meals. Each of the containers includes an outer casing enclosing a temperature controlled container fabricated from an insulating material, from a shipping container fabricator and packing each of the shipping containers with a plurality of individually packaged meals and dry ice for controlling the temperature within the temperature controlled container. It further comprises the step of sending the shipping containers to at least one customer. After removal of the plurality of individually packaged meals, the empty shipping containers are returned to the provider of individually packaged meals. The provider inspects and cleans the returned shipping containers and sanitizes and repacks the returned shipping containers which are undamaged, but the damaged shipping containers are sent to the container fabricator to recycle the outer casing and the insulating material.

61 Claims, 21 Drawing Sheets

CONTAINER, SYSTEM AND PROCESS FOR SHIPPING AND STORING FOOD PRODUCTS AND METHOD FOR RECYCLING SHIPPING AND STORAGE CONTAINERS

This application claims benefit of Provisional Applications 60/070,563, filed Jan. 6, 1998 and 60/072,169 filed Jan. 7, 1998.

BACKGROUND OF THE INVENTION

1. Field of the Invention

The invention relates generally to containers, systems, and processes for shipping and storing food products and to methods for recycling such shipping and storage containers. In particular, it relates to containers for shipping and storing food products having a plurality of chambers, which containers comprise an outer casing enclosing a temperature controlled container fabricated from an insulating material and systems for shipping and storing food products in such containers, which systems employ cooling means to control the temperature within the temperature controlled container. Further, the invention relates to methods for recycling such shipping and storage containers, in which the containers are returned to the food product provider for cleaning and inspection. After cleaning and inspection, the provider may reuse the container, refurbish and then reuse the container, or return of the containers or container components to the container fabricator for recycling.

2. Description of Related Art

The planning of a diet of nutritious meals, the shopping for the ingredients to prepare such meals, and the preparation of the meals themselves are often difficult and time consuming tasks. In particular, working couples, single working persons, and students often find it difficult to find the time to accomplish these tasks. Perhaps more importantly, persons suffering from diet responsive conditions, such as diabetes, are often unable to efficiently and effectively accomplish these tasks.

Although frozen and retorted food products, such as "TV" dinners and retorted soups and stews, have long been available to help persons prepare meals, these are merely aids to the planning and preparation of a diet. Nevertheless, in order to take advantage of the convenience that such frozen and retorted food products provide, the diet must still be planned, and the food products must still be purchased. Further, these food products may most greatly reduce that time and effort spent in preparation of meals. The time and effort expended in the planning and gathering of the ingredients may far outstrip the time and effort actually expended in preparing any and all of the meals. In addition, the importance of the quality of the meals may be of crucial importance. For example, diets consisting of individually packaged meals for persons suffering from a diet responsive condition are described in U.S. Pat. No. 5,639,471 to Chait et al., the disclosure of which is incorporated herein by reference.

While containers exist for shipping and storing chilled or heated food products, these containers provide for shipping and storing a variety of products at a desired temperature. Storing retorted food products, such as soups, at temperatures below the freezing point of water may cause the food products to freeze, and there cans or containers to rupture. Further, prolonged cooling or heating or unnecessary degrees of cooling or heating may adversely effect the organoleptic characteristics of certain food products or their ingredients. For example, prolonged or uncontrolled variations in the degree of cooling or heating may result in changes in the texture of some food products, especially baked goods. Therefore, regardless of the type or quantity of food products to be shipped or stored, the shipping container maintains the food products within a desired temperature range and reduce or eliminate any uncontrolled temperature fluctuations.

SUMMARY OF THE INVENTION

A need has arisen for a container for shipping and storing food products, in which food products, which are to be maintained at a controlled temperature, are segregated from food products, the temperature of which may be allowed to vary more widely with the ambient temperature. It is a feature of such containers that they include a plurality of food product storage chambers. It is a further feature of these containers that they include an outer casing enclosing a temperature controlled container fabricated from an insulating material. It is an advantage of such containers that food products requiring a controlled temperature may be shipped or stored in the temperature controlled chamber.

Moreover, a need has arisen for a container and system for shipping and storing food products which reduces or eliminates spoilage or the loss of organoleptic characteristics, or both, during shipping or storage. It is a feature of such containers or systems that they maintain the food products within a desired temperature range during shipping and storage. It is an advantage of such systems and containers that food products are not unnecessarily or inappropriately subjected to freezing or over heating during shipping or storage.

In addition, a need has arisen for a container and system by which a complete diet of individually packaged meals may be shipped to or stored by dieters. It is a feature of this system and container that the complete diet may provide sufficient individually packaged meals for an extended period of time, e.g., a week. It is an advantage of this system and container that time and effort spent in the planning of a diet, the purchase of meal ingredients, and the preparation of meals may be reduced or minimized.

Yet another need has arisen for a container and system for providing short-term refrigeration immediately prior to, during, and immediately after shipping, e.g., for about 48 hours. It is a feature of the container and system that they include a temperature controlled chamber. It is an advantage of the container and system that it reduces or eliminates spoilage or the loss of organoleptic characteristics, or both, during and immediately before and after shipping.

A further need has arisen for a system for shipping and storing food products, in which certain food products may be maintained at a controlled temperature, while the temperature of other food products is allowed to vary more widely with the ambient temperature. Still a further need has arisen for a container and a system for shipping temperature sensitive food products and for storing such food products before or after shipping. It is a feature of such containers that cooling means may be used to control the temperature of food products shipped or stored in the temperature controlled chamber. It is an advantage of the system that food products may be shipped directly from the food product producer or provider to a consumer or dieter with reduced or eliminated exposure of temperature sensitive food products to temperature variations.

Still another need has arisen for a method for recycling shipping and storing containers, in which food products may be shipped to a consumer or dieter and in which such containers may be returned to a producer or provider of individually packaged meals for repackaging or delivered to a collection point to be recovered for inspection and cleaning by the producer or provider of individually packaged meals. It is a feature of this method that the returned or recovered containers may be inspected and cleaned by the producer or provider prior to reuse or that the containers may be refurbished by the producer or provider prior to reuse or returned to the container fabricator for recycling of its components. It is an advantage of this method that the producer or provider of individually packaged meals may decide to reuse the container or to transfer the container or its components for recycling the containers.

In an embodiment of the invention, a container for shipping and storing food products in a plurality of chambers comprises a temperature controlled container fabricated from an insulating material. The temperature controlled container includes a lid and a base. The base comprises a base chamber including a plurality of channels formed on the interior of the base chamber. The lid comprises a first side for sealing the base chamber, which includes a plurality of channels formed in the first side, and a lid chamber. Further, the lid chamber may be divided into a plurality of food product receiving chambers, and the temperature controlled container may be enclosed in an outer casing. Sealing means are formed on the lid and on the base for sealing the base chamber. Further, the temperature controlled container may be enclosed within as outer casing.

In another embodiment of the invention, a container for shipping and storing food products in a plurality of chambers comprises an outer casing enclosing a temperature controlled container fabricated from an insulating material. Again, the temperature controlled container including a lid and a base. The base comprises a bottom portion and at least one base side wall having an upper base side wall edge and a lower, base side wall edge, whereby the lower, base side wall edge of the at least one base side wall is affixed to the floor portion to form a fluid tight seal between the at least one base side wall and the bottom portion, thereby forming a base chamber. The base chamber includes a plurality of channels formed in the at least one side wall and a plurality of channels formed in the floor portion. The lid comprises a top portion having a first side for sealing the base chamber and at least one lid side wall having an upper, lid side wall edge and a lower, lid side wall edge whereby the lower, lid side wall edge of the at least one lid side wall is affixed to the top portion to form a fluid tight seal between the at least one base lid wall and the top portion, thereby forming a lid chamber. The lid chamber may include at least one partition affixed to a second side of the top portion, which divide the lid chamber into a plurality of food product receiving chambers, and the top portion having a plurality of channels formed in the first side of the top portion. Once again, sealing means are formed on the lid and on the upper, base side wall edge for sealing the base chamber.

In still another embodiment of the invention, a system for shipping and storing food products in a plurality of chambers comprises a container including an outer casing enclosing a temperature controlled container fabricated from an insulating material. The temperature controlled container includes a lid and a base. The base comprises a base chamber including a plurality of channels formed on the interior of the base chamber. The lid comprises a first side for sealing the base chamber, which includes a plurality of channels formed in the first side, and a lid chamber divided into a plurality of food product receiving chambers. Sealing means are formed on the lid and on the base for sealing the base chamber, and cooling means are positioned within the temperature controlled container with respect to a plurality of food products to control the temperature within the temperature controlled container.

In yet another embodiment of the invention, a method for recycling a shipping container comprises the steps of providing shipping containers to a producer or provider of individually packaged meals from a shipping container fabricator and packing each of the shipping containers with a plurality of individually packaged meals and cooling means for controlling the temperature within the temperature controlled container. Each of the containers includes an outer casing enclosing a temperature controlled container fabricated from an insulating material. It further comprises the step of sending the shipping containers to at least one consumer or dieter. After removal of the plurality of individually packaged meals, the empty shipping containers are returned to the provider of individually packaged meals. The producer or provider inspects the returned shipping containers and cleans and repacks the returned shipping containers which are undamaged, but damaged shipping containers may be refurbished by the producer or provider or may be sent to the container fabricator for recycling of the outer casing or the insulating material, or both.

In still an additional embodiment, a process for shipping a plurality of frozen, individually packaged meals may comprise the steps of providing a shipping container, the containers including an outer casing enclosing a temperature controlled container fabricated from an insulating material and stabilizing a plurality of individually packaged meals at a temperature less than 0° C., e.g., at about −22° C. The plurality of stabilized, individually packaged meals then may be packed into the temperature controlled container and cooling means may be placed within the temperature controlled container.

Other needs satisfied by the invention, features, and advantages will be understood in view of the following description of preferred environments with respect to the accompanying drawings.

DESCRIPTION OF THE DRAWINGS

For a more complete understanding of the present invention, the needs satisfied thereby, and the features and advantages thereof, reference now is made to the following descriptions taken in connection with the accompanying drawings in which.

DETAILED DESCRIPTION OF PREFERRED EMBODIMENTS

A Shipping and Storing Container

Figure 1:
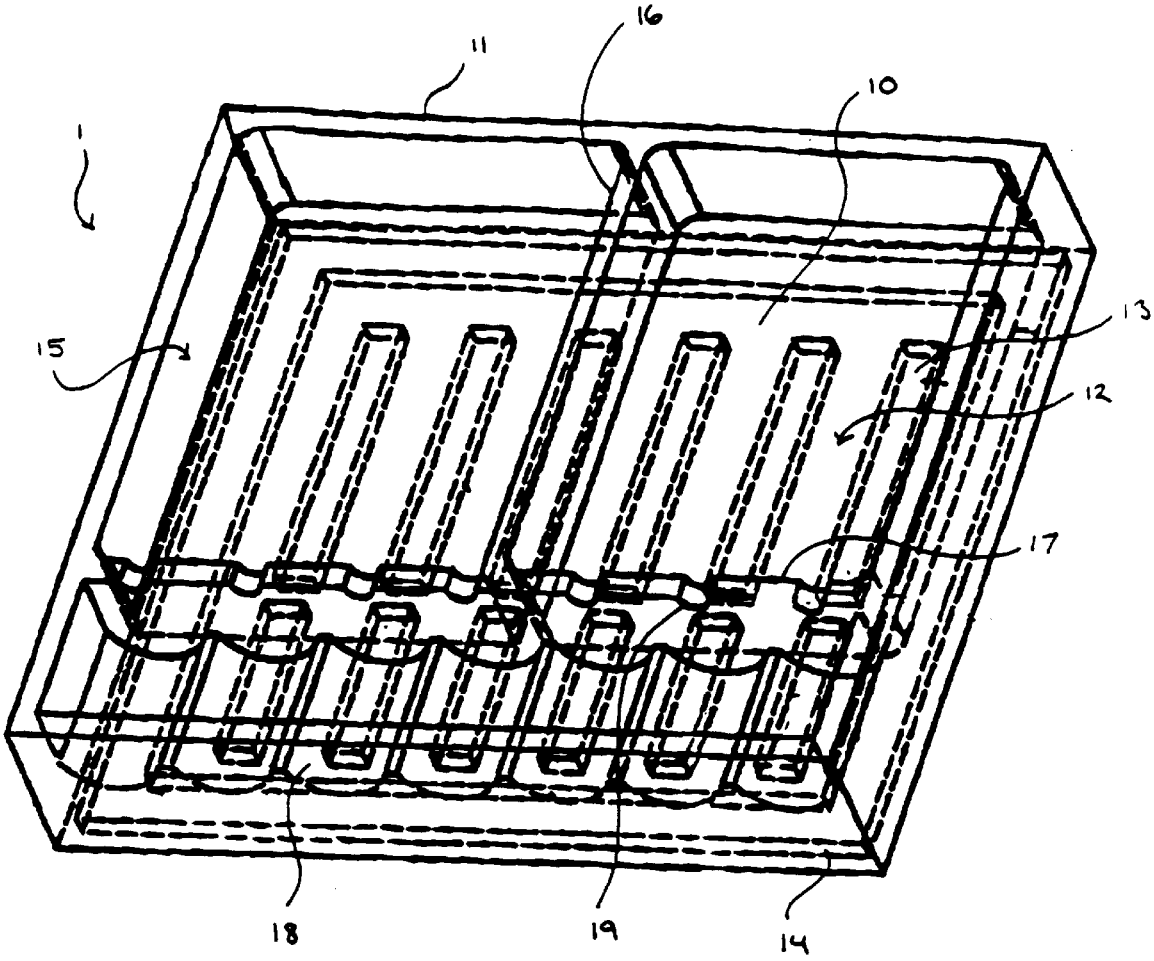
FIG. 1 is a perspective, transparent view of a lid of a temperature controlled container in accordance with a first embodiment of the invention.

Referring to FIG. 1, a perspective, transparent view of a lid 1 of a temperature controlled container in accordance with a first embodiment of the invention is depicted. Lid 1 is fabricated out of an insulating material, such as expanded polystyrene (EPS). Nevertheless, the insulating material also may be selected from the group consisting of polyethylene foam, polypropylene foam, ethyl vinyl acetate-polyethylene copolymer foam, ethylene vinyl acetate foam, polyolefin-based foam, polyethylene terephthalate foam, and polyurethane foam. Further, the insulating material also may be an evacuated, open or closed cell foam. Such an evacuated foam may be wrapped (and sealed) in Mylar® film, a metalized gas-barrier film, or another vacuum preserving barrier. Preferredly, the insulating material has an R value of at least about 0.0022 F°hr/Btu, and still more preferredly, the insulating material has an R value of greater than about 0.0022 F°hr/Btu. In addition, the insulating material may have a density in a range of about 1.35 to about 1.65 pounds per cubic foot, e.g., about 1.5 pounds per cubic foot. Lid 1 comprises a substantially rectangular top portion 10 and four lid side walls 11. A plurality of top ventilation channels 12 are formed on one side of top portion 10 by a plurality of top ventilation ridges 13.

Together, top portion 10 and four lid side walls 11 define a lid chamber 15 on the side of top portion 10 opposite ventilation channels 12 and top ventilation ridges 13. Lid chamber 15 is divided into two lid chambers by a lid chamber partition 16, and a can receptacle partition 17 separates a plurality of can receptacles 18 from the two divided chambers of lid chamber 15. Each of can receptacles 18 is designed to receive a can or other container of a retorted food product (not shown), such as a can of retorted soup or stew. Moreover, can receptacle partition 17 is equipped with a plurality of finger gaps 19, one of which corresponds to each of can receptacles 18. Finger gaps 19 simplify the removal of cans or other containers of retorted food product from can receptacles 18.

In addition, a barrier (not shown) comprising a sheet of a polymer material, such as polyethylene terephthalate, a polyolefin film, or other polymer moisture barrier, may be placed over the open side of lid chamber 15. For example, the barrier may be moisture resistant and may comprise a sheet of polymer material, heat sealed to flattened upper edges of the side walls 11 and partitions 16 and 17.

Although the contents of lid chamber 15 are not maintained in a controlled temperature environment, such as that created within the temperature controlled container, the temperature controlled container effects the temperature of the food products shipped and stored within chamber. In particular, because temperature is controlled within the temperature controlled container, the temperature of food products is not permitted to vary freely with the ambient temperature. Moreover, because of the temperature extremes achieved by the ambient temperature, especially during shipping, some of the food products shipped or stored in lid chamber 15 could be damaged or would degrade if allowed to vary freely with the ambient temperature. Thus, the temperature controlled container has a dampening effect upon the temperature of food products shipped or stored in lid chamber 15.

Figure 2:
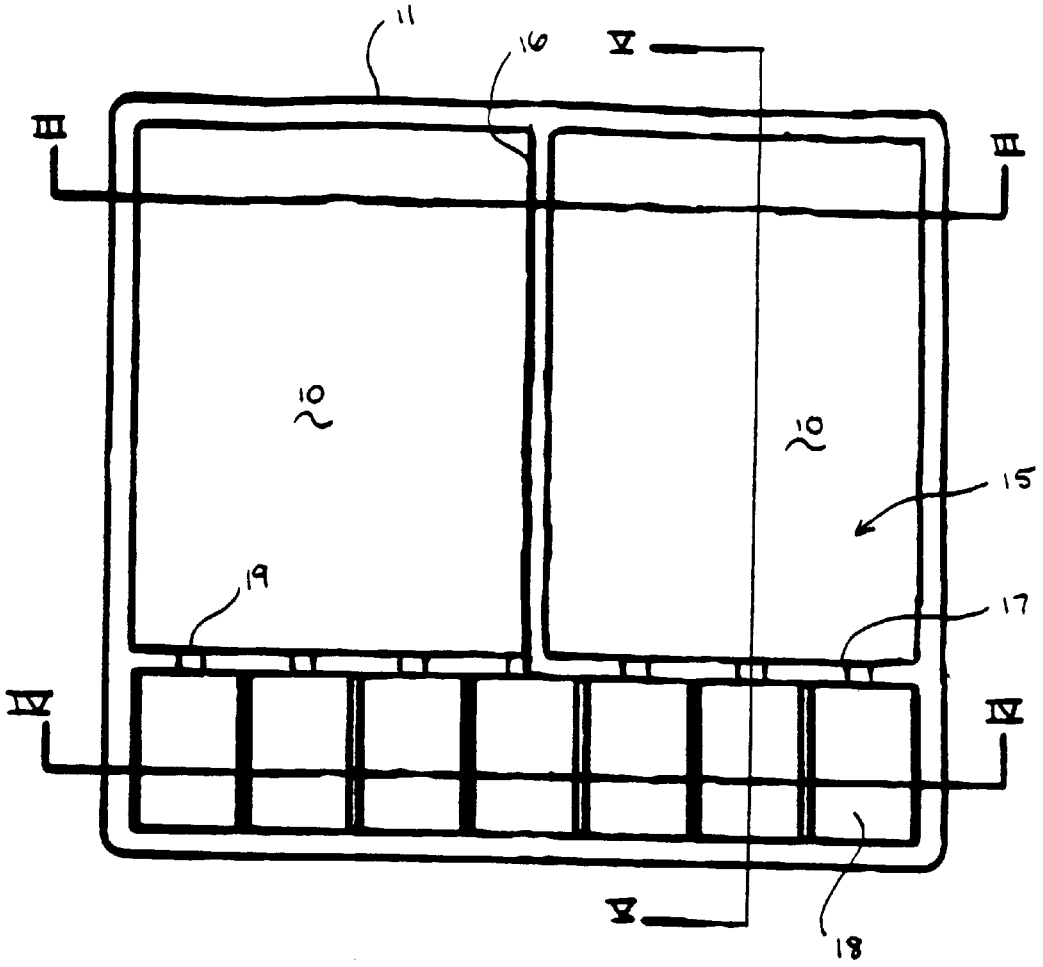
FIG. 2 is an overhead view of the lid of FIG. 1.
Figure 3:
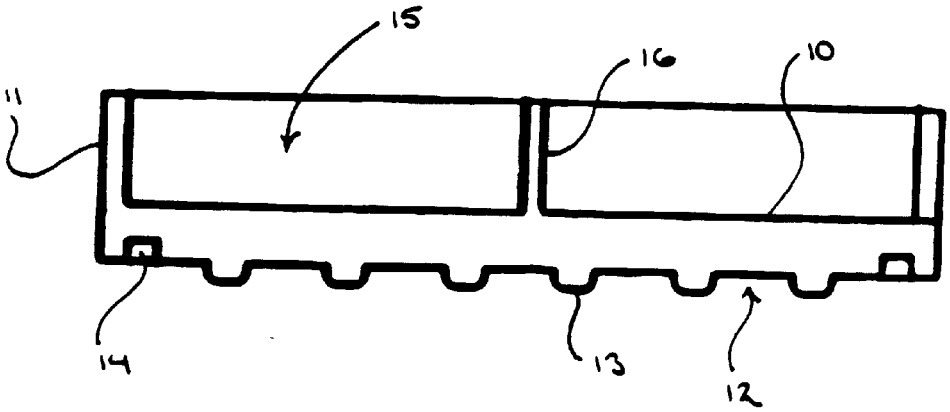
FIG. 3 is a cross-sectional view of the lid of FIG. 2 along line III—III.
Figure 4:
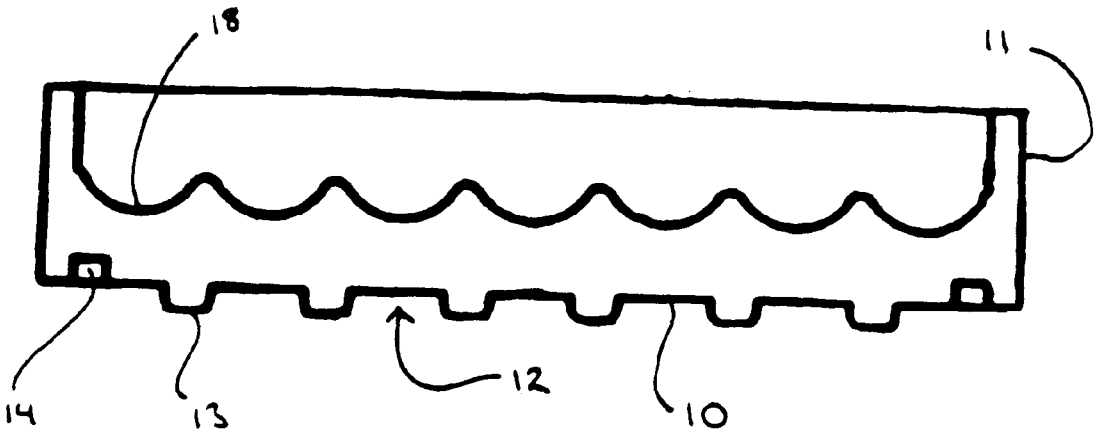
FIG. 4 is a cross-sectional view of the lid of FIG. 2 along line IV—IV.
Figure 5:
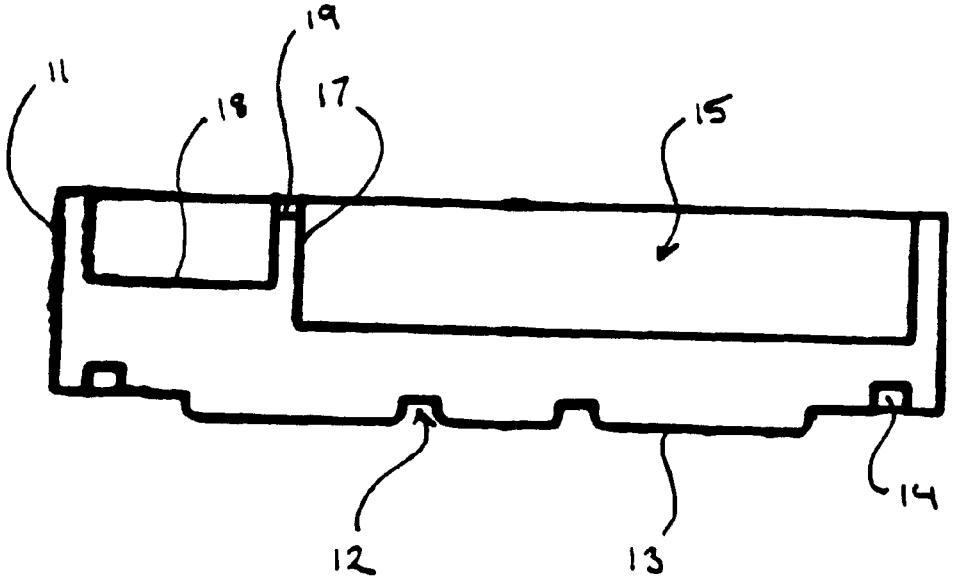
FIG. 5 is a cross-sectional view of the lid of FIG. 2 along line V—V.

FIG. 2 is an overhead view of lid 1 of FIG. 1. In FIG. 2, divided lid chamber 15 is shown, and can receptacle partition 17 is shown to further separate seven can receptacles 18 from lid chamber 15. FIG. 3 is a cross-sectional view of lid 1 of FIG. 2 along line III—III and shows the ventilation channels 12 formed on the side of top portion 10 opposite lid chamber 15 by top ventilation ridges 13. Similarly, FIG. 4 is a cross-sectional view of lid 1 of FIG. 2 along line IV—IV, which shows the curved shape of can receptacles 18. Further, FIG. 5 is a cross-sectional view of lid 1 of FIG. 2 along line V—V, and shows both the cross-section of lid chamber 15 and one of can receptacles 18. Referring generally to FIGS. 3–5, together, these figures show the variation in the thickness of lid 1 over various points on its surface. Nevertheless, lid 1 preferably has a thickness of not less than about one inch, and more preferably, the thickness of lid 1 is in a range of about one inch to about two inches, and still more preferably, the thickness of lid 1 is in a range of about one inch to about 1.5 inches.

Figure 6:
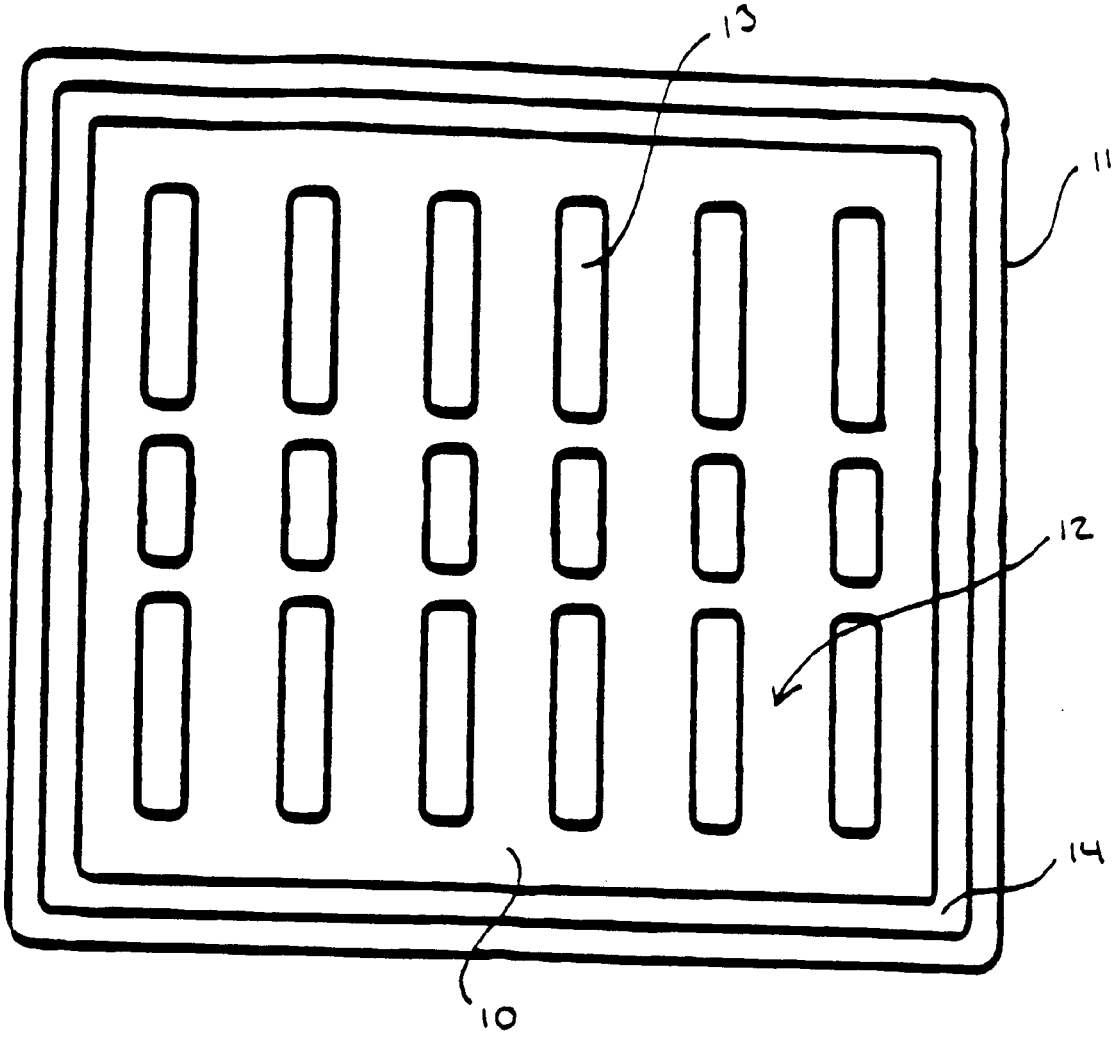
FIG. 6 is a bottom view of the lid of FIG. 2.

FIG. 6 is a bottom view of lid 1 of FIG. 2, which shows the plurality of top ventilation channels 12 formed on one side of top portion 10 by the plurality of top ventilation ridges 13. FIG. 6, as well as the previous figures, also depicts a sealing groove 14. Sealing groove 14 mates with a corresponding structure on the base of the temperature controlled container of the invention to form sealing means for the container.

Figure 7:
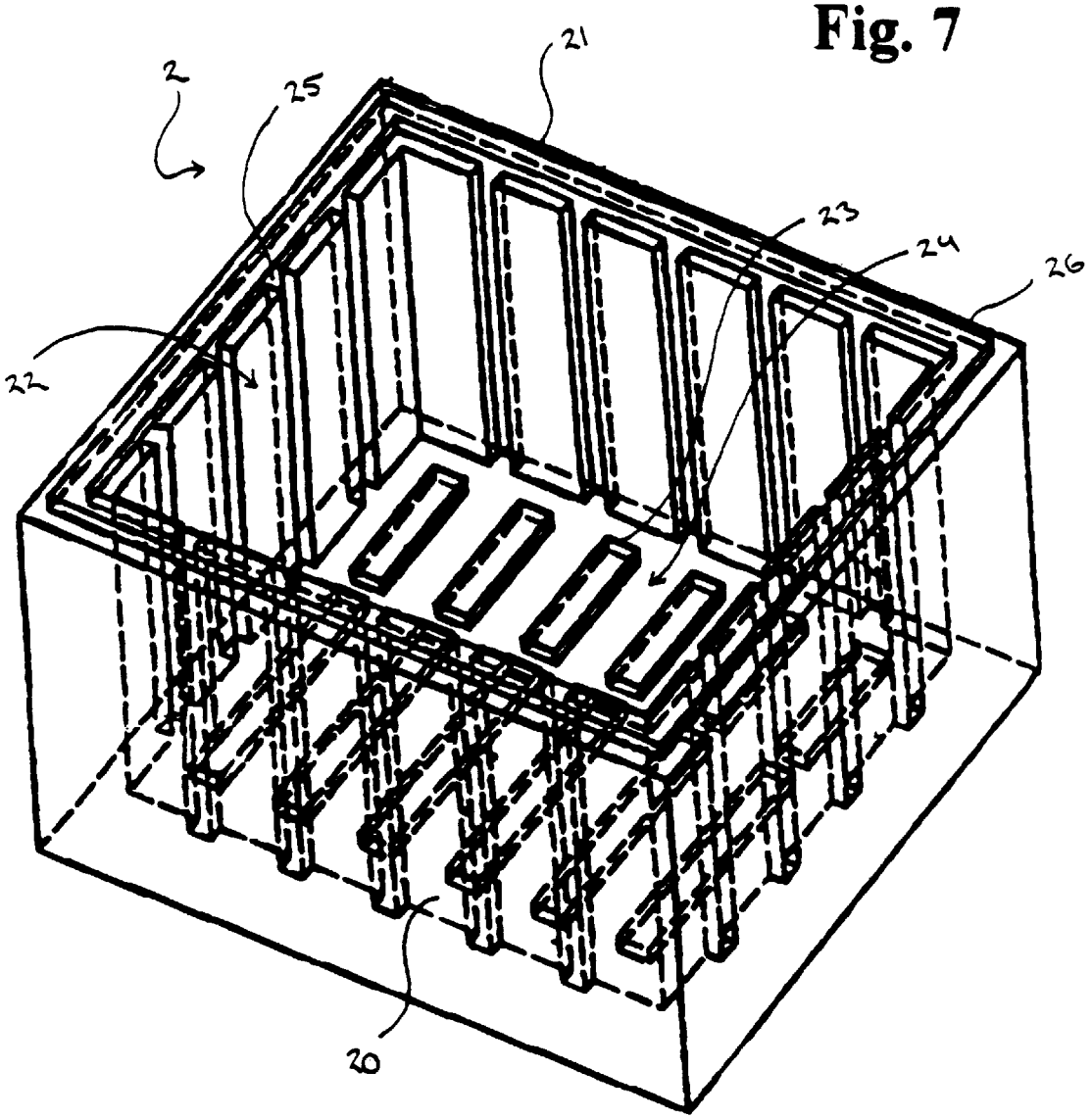
FIG. 7 is a perspective, transparent view of a base of a temperature controlled container in accordance with a first embodiment of the invention.

Referring to FIG. 7, a perspective, transparent view of a base 2 of a temperature controlled container in accordance with a first embodiment of the invention is depicted. As noted above, with respect to lid 1, base 2 also is fabricated out of an insulating material, such as expanded polystyrene (EPS). Preferredly, the insulating material has an R value of at least about 0.0022 F°hr/Btu, and has a density in a range of about 1.35 to about 1.65 pounds per cubic foot, e.g., about 1.5 pounds per cubic foot. Base 2 comprises a substantially rectangular bottom portion 20 and four base side walls 21, which together define a base chamber 22. A plurality of bottom ventilation ridges 23 are formed on the side of bottom portion 20 which faces the interior of base chamber 22. A plurality of bottom ventilation channels 24 are on the interior side of bottom portion 20 by the plurality of top ventilation ridges 23. In addition, a plurality of side wall ventilation channels 25 are formed in side walls 21. Bottom ventilation channels 24 and side wall ventilation channels 25 function with top ventilation channels 12 to ensure an adequate circulation of temperature controlled air around the products stored or shipped in the claimed container. In addition, bottom ventilation channels 24 conduct any moisture forming within the temperature controlled container away from the food products.

As noted above, sealing groove 14 depicted in FIG. 6 is designed to mate with a corresponding structure on base 2 the temperature controlled container of the invention to form sealing means for the container. In particular, FIG. 7 depicts a sealing lip 26 that is received by sealing groove 14 to seal the container. Although FIGS. 1–7 depict a substantially rectangular sealing 2 lip 26 for insertion into substantially rectangular sealing groove 14, the sealing means is not limited to these components or their respective configurations. Sealing lip 26 and sealing groove 14 may be formed in other geometric shapes or, for example, may be formed on the inner surface of base side wall 21 and on the outer surface of lid side walls 11, respectively.

Figure 8:
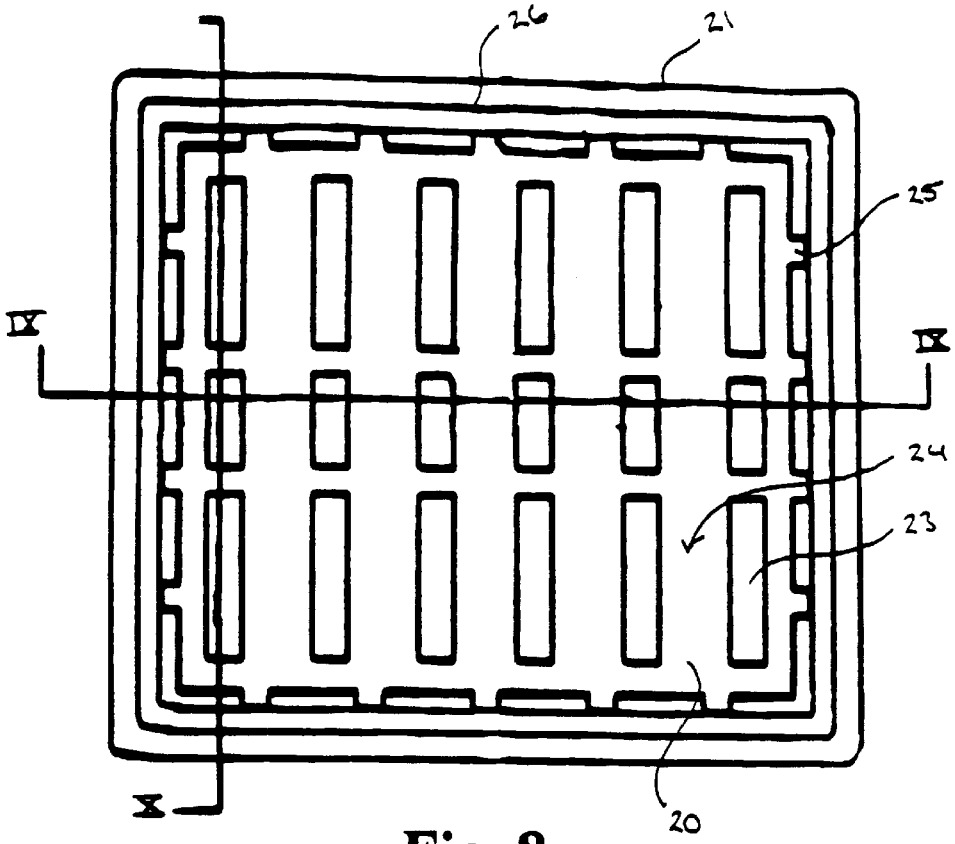
FIG. 8 is an overhead view of the base of FIG. 7.

FIG. 8 is an overhead view of base 2 of FIG. 7. In FIG. 8, the interior of base chamber 22 is shown, and the pattern formed by the plurality of bottom ventilation channels 24 on the interior side of bottom portion 20 by the plurality of bottom ventilation ridges 23 is shown. In addition, the pattern formed by the plurality of side wall ventilation channels 25 on side walls 21 also is shown. These channels may be formed by cutting strips of the insulating material from container base 2. Preferredly, these strips are of equal depth and are spaced at a constant interval about the periphery of base chamber 22 and across bottom portion 20 of base 2. By regularly spacing these channels throughout base 2, as well as on lid 1, more uniform air flow throughout the container and around the stored or shipped food products may be achieved. For example, if bottom portion 20 and side walls 21 may have a thickness in a range of about one inch to about two inches, and preferably, of about 1.5 inches, the channels may be formed by cutting strips of insulating material having a depth less than or equal to about one inch, and preferably, of about 0.5 inches, at two inch intervals around the periphery of side walls 21 of base 2. Alternatively, these ventilation channels may be formed by molding lid 1 and base 2.

Figure 9:
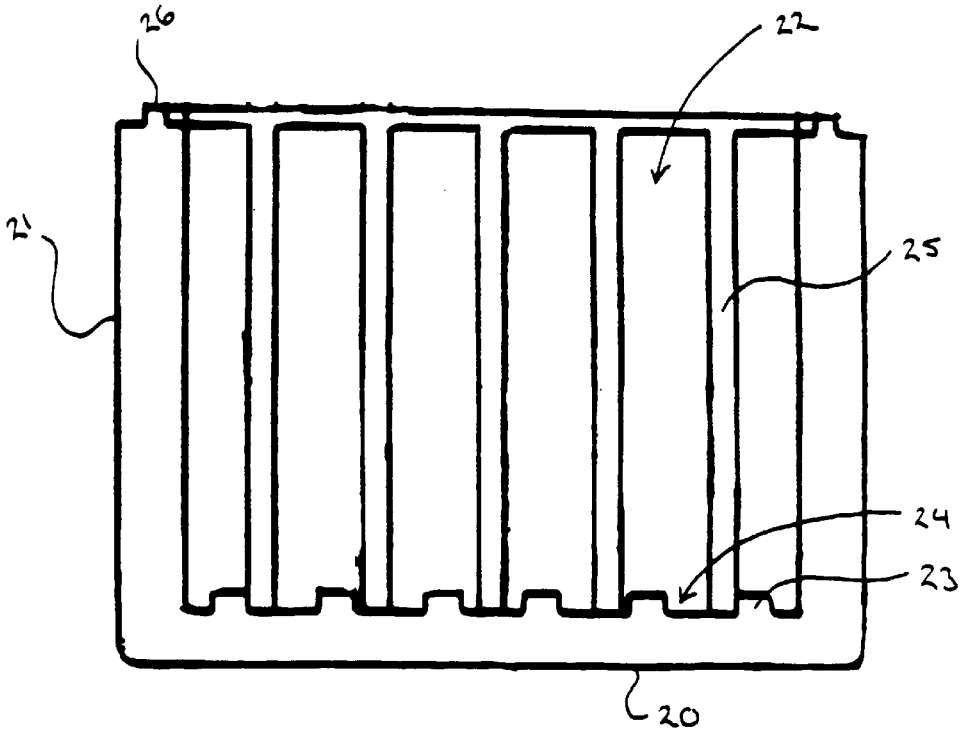
FIG. 9 is a cross-sectional view of the base of FIG. 8 along line IX—IX.
Figure 10:
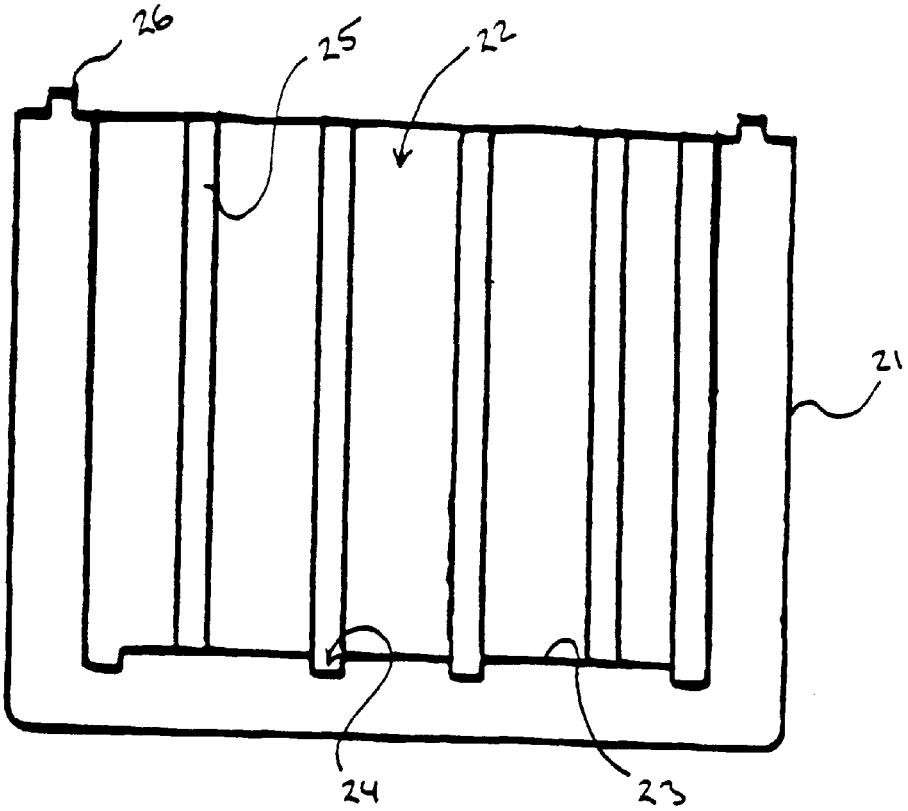
FIG. 10 is a cross-sectional view of the base of FIG. 8 along line X—X.

FIG. 9 is a longitudinal cross-sectional view of base 2 of FIG. 7 along line IX—IX and shows ventilation channels 25 formed on side walls 21 of base 2. Similarly, FIG. 10 is a lateral cross-sectional view of base 2 of FIG. 7 along line X—X. Each of these views also depicts sealing lip 26 of base 2. Referring generally to FIGS. 7–10, together these figures show the variation in the thickness of base 2 over various points on its surface. Nevertheless, base 2 preferably has a thickness of not less than about one inch, and more preferably, the thickness of base 2 is in a range of about one inch to about two inches, and still more preferably, the thickness of base 2 is in a range of about one inch to about 1.5 inches. In addition, a gap (not shown) is formed between lid 1 and base 2 in a range of less than about 0.006 inches. This gap permits gases to escape from the container, but maintains a substantially liquid tight seal. Moreover, this seal reduces or prevents dust, dirt, and small objects from entering access to the container.

The size of lids 1 and bases 2, as depicted in FIGS. 1–10, may be varied, so that the volume of the temperature controlled container may be adjusted to carry a various numbers of individually packaged meals. Nevertheless, adjustments to the volume of the container must maintain the insulating capability of the container. Further, although the number of individually packaged meals may be reduced, the container must remain capable of holding a sufficient amount of cooling means, such as dry ice, to maintain a desired temperature of the meals for a desired shipping and storage period.

Lid 1 and base 2 may be fabricated by either of at least two methods. First, lid 1 and base 2 may be molded as single components. Alternatively, individual slabs or blocks of insulating material may be assembled, e.g., glued or taped together, to form lid 1 or base 2. Although the molding of the components as single units may be a somewhat complex operation and may require expensive, specially designed molding equipment, the molding of lid 1 and base 2 as single units may be less time consuming than their individual construction from slabs or blocks of insulating material. Molding machines generally may manufacture containers at a faster rate than human assemblers and their cost per unit output may be lower than that of human assemblers, but there remain advantages to human assembly. For example, human assemblers may be more likely to discover mistakes in fabrication and may also be able to react more quickly to changes in container design or to the requirements of new food products. Moreover, as discussed in greater detail below, the container and system of this invention may be used as part of method for recycling the shipping and storage containers and their components. Therefore, it may be desirable to retain the ability to rapidly inspect and to clean and to repair or to refurnish damaged containers. In particular, it may be desirable to retain the ability to make unique repairs and modifications to existing containers.

Figure 11:
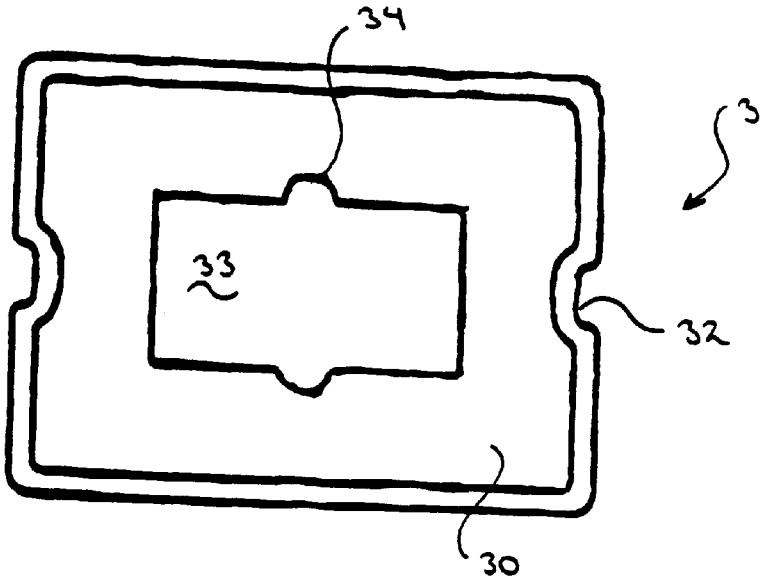
FIG. 11 is an overhead view of a lid of a temperature controlled container in accordance with a second embodiment of the invention.

Referring to FIG. 11, an overhead view of a lid 3 of a temperature controlled container in accordance with a second embodiment of the invention is depicted. This container is designed to be significantly smaller than the containers described in FIGS. 1–10 and is intended for use in sending samples of the individually packaged meals to prospective consumers or dieters. Lid 3 comprises a top portion 30 having a pair of lid lifting points 32. Top portion 30 includes an integrally formed lid chamber 33. Lid chamber 33 has a pair of lid chamber finger gaps 34 to simplify the removal of food product packages from lid chamber 33.

Figure 12:
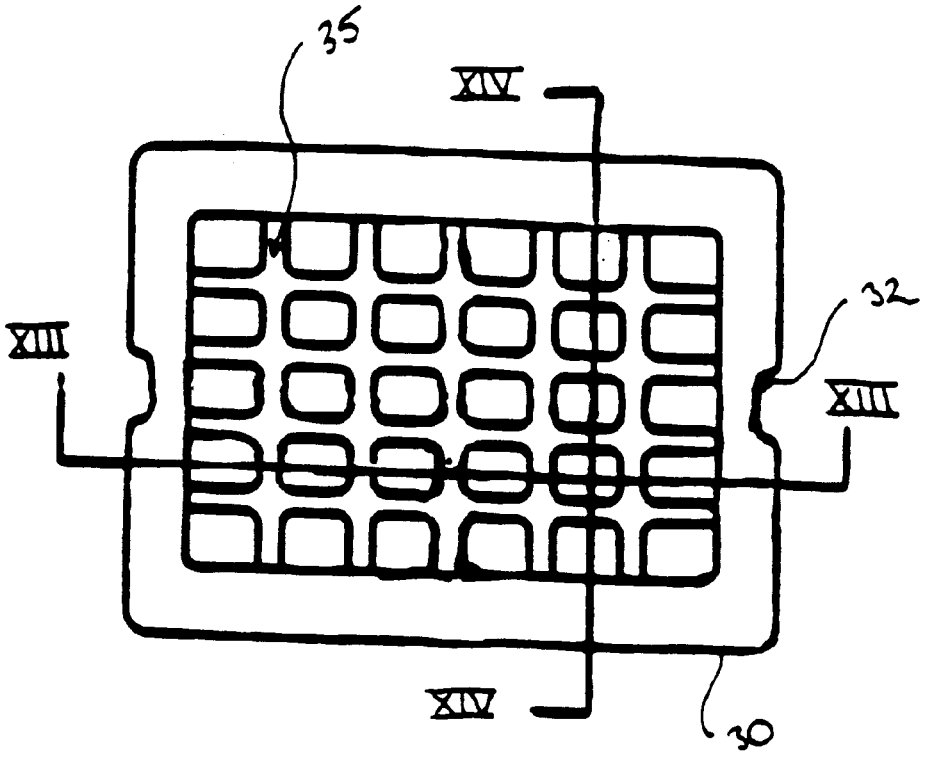
FIG. 12 is a bottom view of the lid of FIG. 11.
Figure 13:
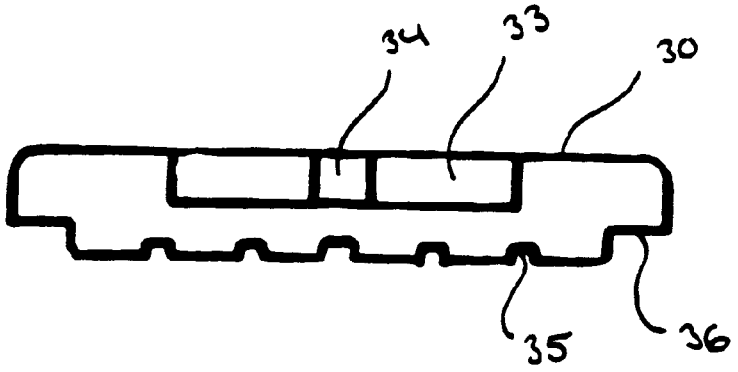
FIG. 13 is a cross-sectional view of the lid of FIG. 11 along line XIII—XIII.
Figure 14:
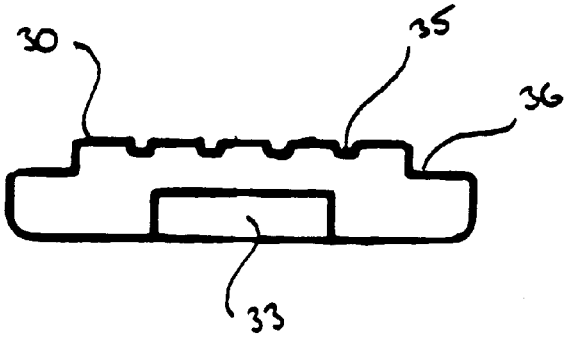
FIG. 14 is a cross-sectional view of the lid of FIG. 11 along line XIV—XIV.

FIG. 12 is a bottom view of lid 3 of FIG. 11. A plurality of crisscrossing, top ventilation channels 35 are integrally formed in top portion 30 of lid 3. FIG. 13 is a cross-sectional view of lid 3 of FIG. 11 along line XIII—XIII, and FIG. 14 is a cross-sectional view of the lid of FIG. 11 along line XIV—XIV. As depicted in FIGS. 13 and 14, sealing means for this embodiment of the container comprises a sealing groove 36 formed about the periphery of top portion 30 of lid 3.

Figure 15:
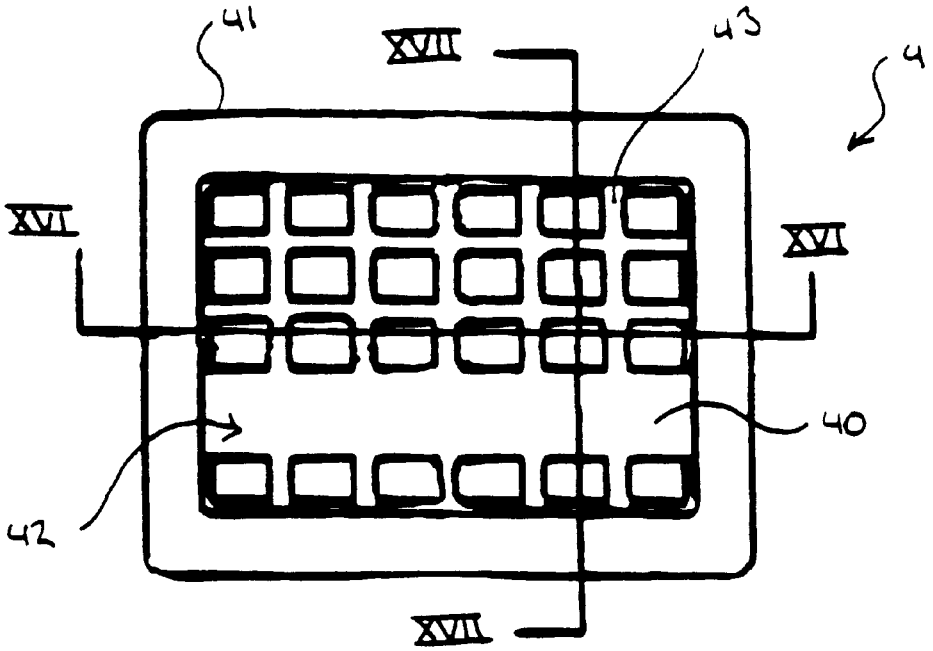
FIG. 15 is an overhead view of a base of a temperature controlled container in accordance with a second embodiment of the invention.
Figure 16:
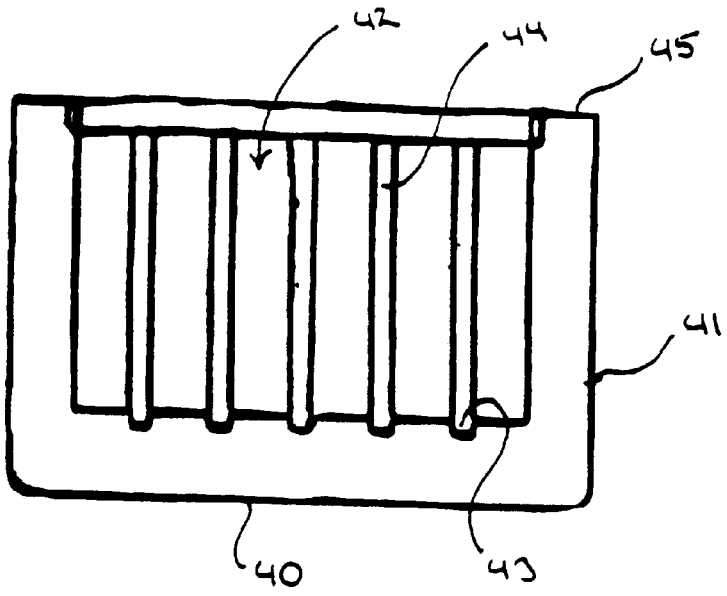
FIG. 16 is a cross-sectional view of the base of FIG. 15 along line XVI—XVI.
Figure 17:
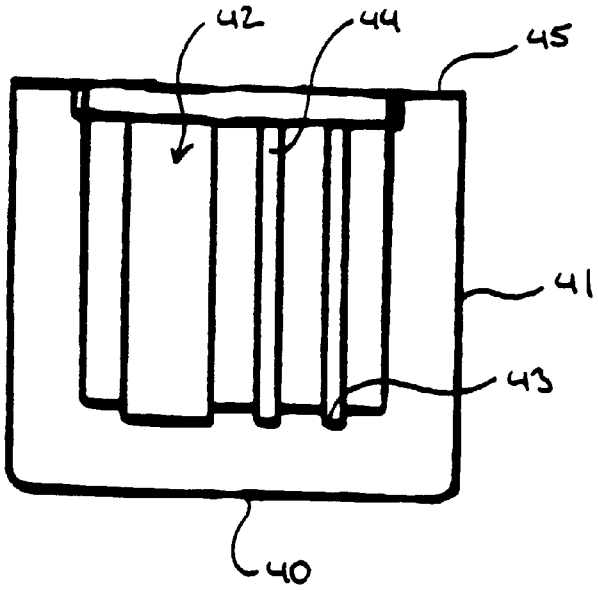
FIG. 17 is a cross-sectional view of the base of FIG. 15 along line XVII—XVII.

Referring to FIG. 15, an overhead view of a base 4 of a temperature controlled container is depicted in accordance with a second embodiment of the invention. Base 4 comprises a substantially rectangular, bottom portion 40 and four side walls 41, which together form a base chamber 42. As with the bases described above, bottom portion 40 is equipped with a plurality of bottom ventilation channels 43. FIG. 16 is a cross-sectional view of base 4 of FIG. 15 along line XVI—XVI, and FIG. 17 is a cross-sectional view of base 4 of FIG. 15 along line XVII—XVII. These figures depict cross-sections of the container along the longitudinal and lateral axes of the container. Each of these figures shows that the container includes a plurality of side wall ventilation channels 44 and a sealing lip 45 which mates with sealing groove 36 to seal the container.

In addition, because of the small size of these containers, the containers have been modified to accommodate a vertically oriented slab of dry ice as the cooling means. Referring to FIGS. 15 and 17, a gap is created by varying the spacing of the ventilation channels 43 and 44, such that the individually packaged meals may be stacked on end within the container and a slab of dry ice also may be stood upright in the container to maintain the temperature of the food products.

A Shipping and Storing System

A system for shipping and storing food products in a plurality of chambers comprises a container including an outer casing enclosing a temperature controlled container fabricated from an insulating material. The outer casing may be fabricated from corrugated paper, which may have a thickness of about 0.25 inch, and in a preferred embodiment, the outer casing may be white in color or another reflective color to reduce absorption of radiant heat by the shipping container. Moreover, the corrugated insulating material may have an R value of at least about 0.0005 F°hr/Btu. In addition, the outer casing may include a liner surrounding the insulated container. The liner may be a simple mono layer of low density polyethylene (LDPE) or may be a more complex mono layer including a copolymer blend. For example, the liner may contain LDPE and ethyl vinyl acetate (EVA). Further, the liner may also include portions of linear low density polyethylene. The EVA may enhance the sealability of the liner. In addition, the outer casing may be sealed with stretch wrap or with plastic or metal sealing bands, or combinations thereof.

Figure 24:
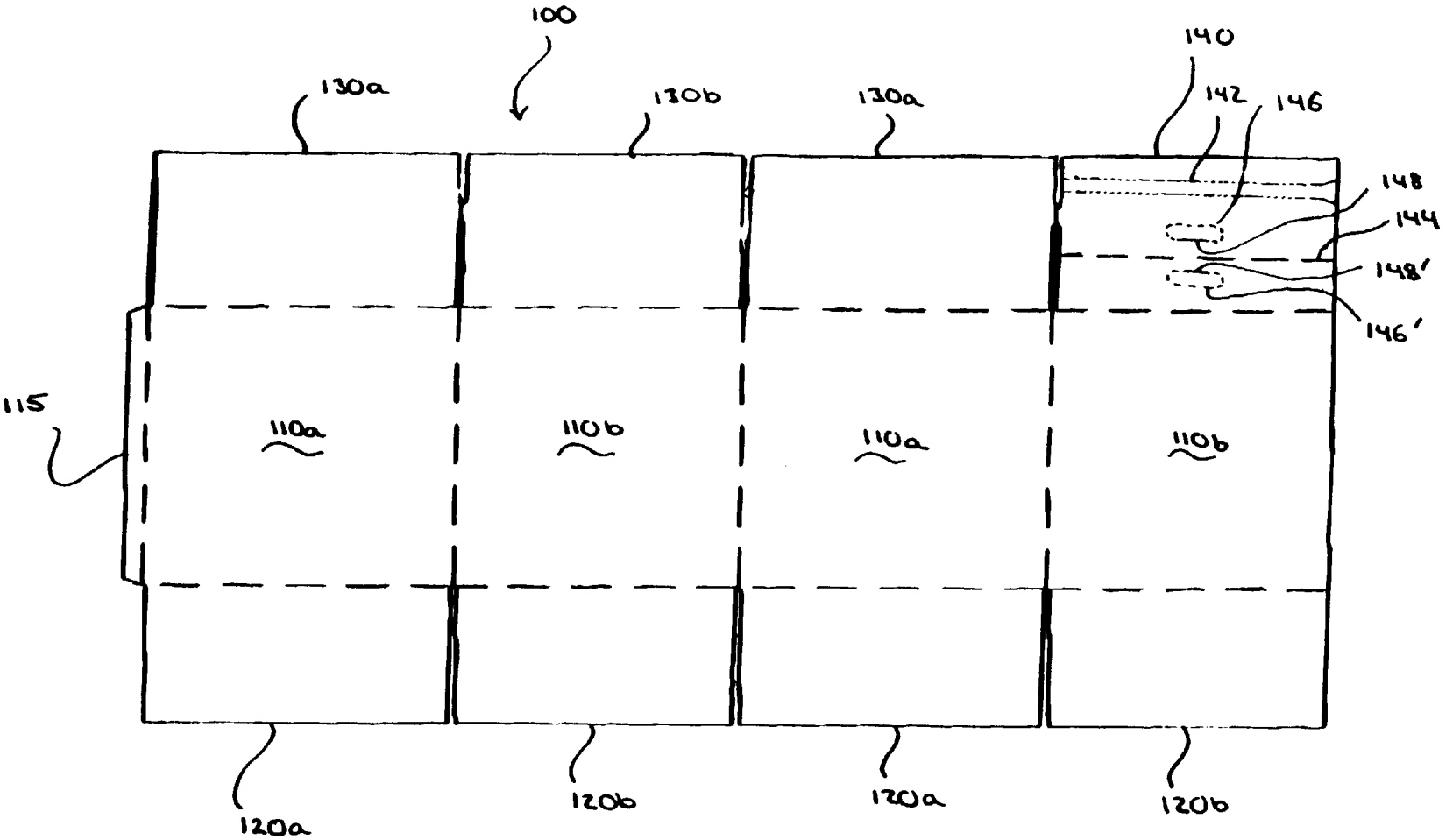
FIG. 24 is an unassembled outer casing equipped with a first embodiment of a hand-hold.

The outer casing may be a regular slotted case (RSC) having extended top flaps. Further, the outer casing may have a single hand-hold, which may be formed as a perforated oval or other geometric shape in the upper surface of the outer casing to permit the container to be dragged to a location, e.g., to a refrigerator or freezer, for unpacking. Referring to FIG. 24, a substantially rectangular outer casing 100 may have four panels, e.g., two wider or length panels 110*a* and two narrower or width panels 110*b*, and a sealing tab 115. Both of panels 110*a* and one of panels 110*b* are fitted with a pair of flaps 120*a* and 130*a* or 120*b* and 130*b*, respectively. One of panels 110*b*, however, is fitted with an extended flap 140 that may be equipped with a perforated, tear strip or "zipper" 142.

Figure 25:
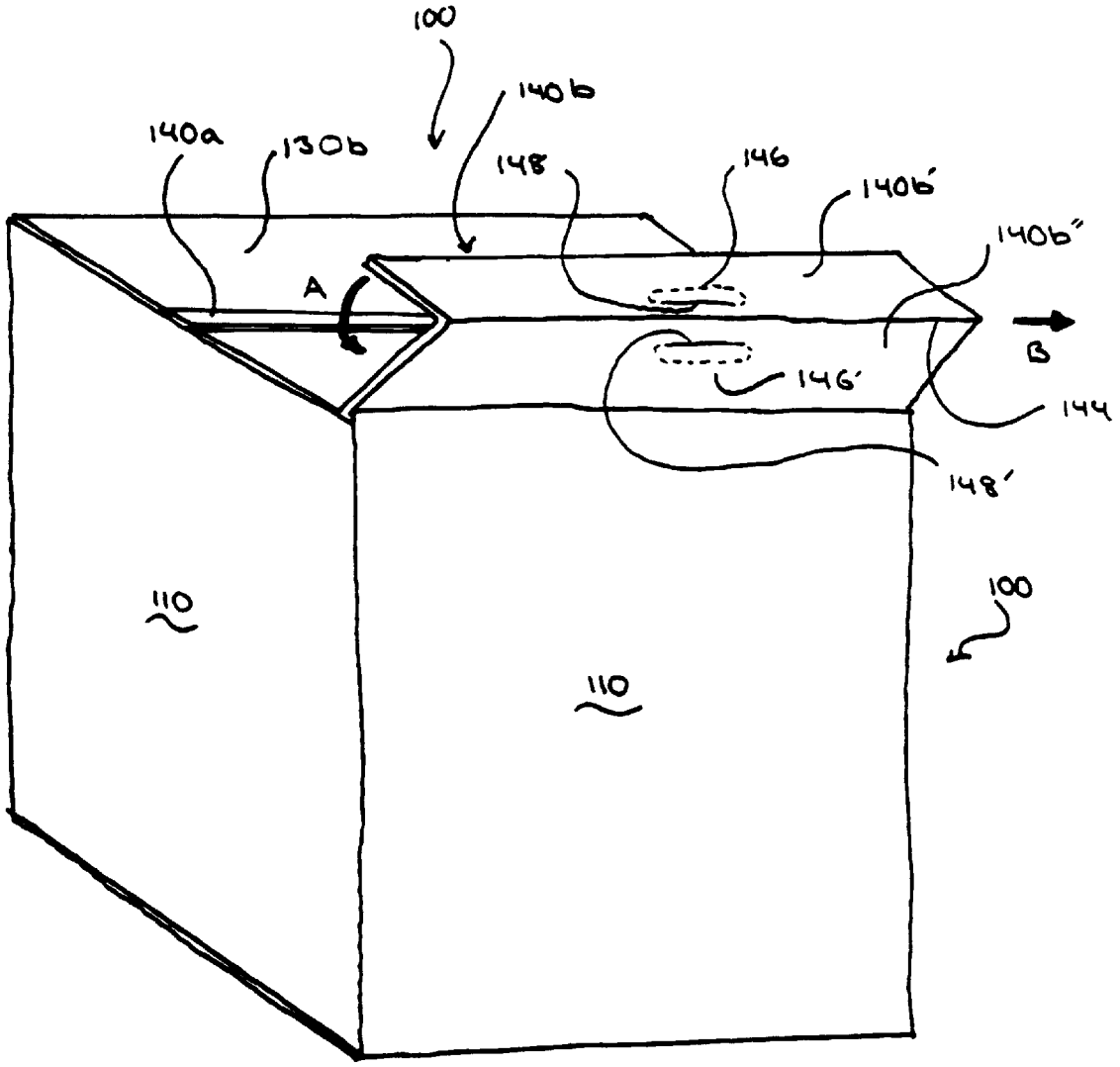
FIG. 25 is an assembled outer casing according to FIG. 24.

As shown in FIG. 25, zipper 142 may be torn away to release flap end 140*b* of extended flap 140 while leaving another flap end 140*a* fixed to outer casing 100. Released flap end 140*b* may be scored along seam 144, such that released flap end 140*b* may be folded over upon itself in the direction of arrow A. The hand-hold may be formed in folded, released flap end 140*b* by mirrored sets of perforations 146 and 146' formed in each portion 140*b*' and 140*b*" of folded, released flap end 140*b*. Each of these mirrored sets of perforations 146 and 146' extend substantially around the periphery of each hand-hold shape, but each hand-hold shape also is scored along mirrored seams 148 and 148' on the side of each hand-hold shape closest to the folded score on seam 144 in released flap end 140*b*. When flap material between each of perforations 146 and 146' is broken, the hand-hold shapes may be folded toward the folded score of seam 144 of released flap end 140*b* to form a 4-ply hand-hold. Thus, the hand-hold is thickened to increase the strength of the hand-hold and to make grasping the hand-hold more comfortable. Because the shipping container may be dragged, rather than carried, to an unpacking location by pulling released flap end 140*b* in the direction of arrow B, the shipping container is easier and less awkward to move.

Figure 26:
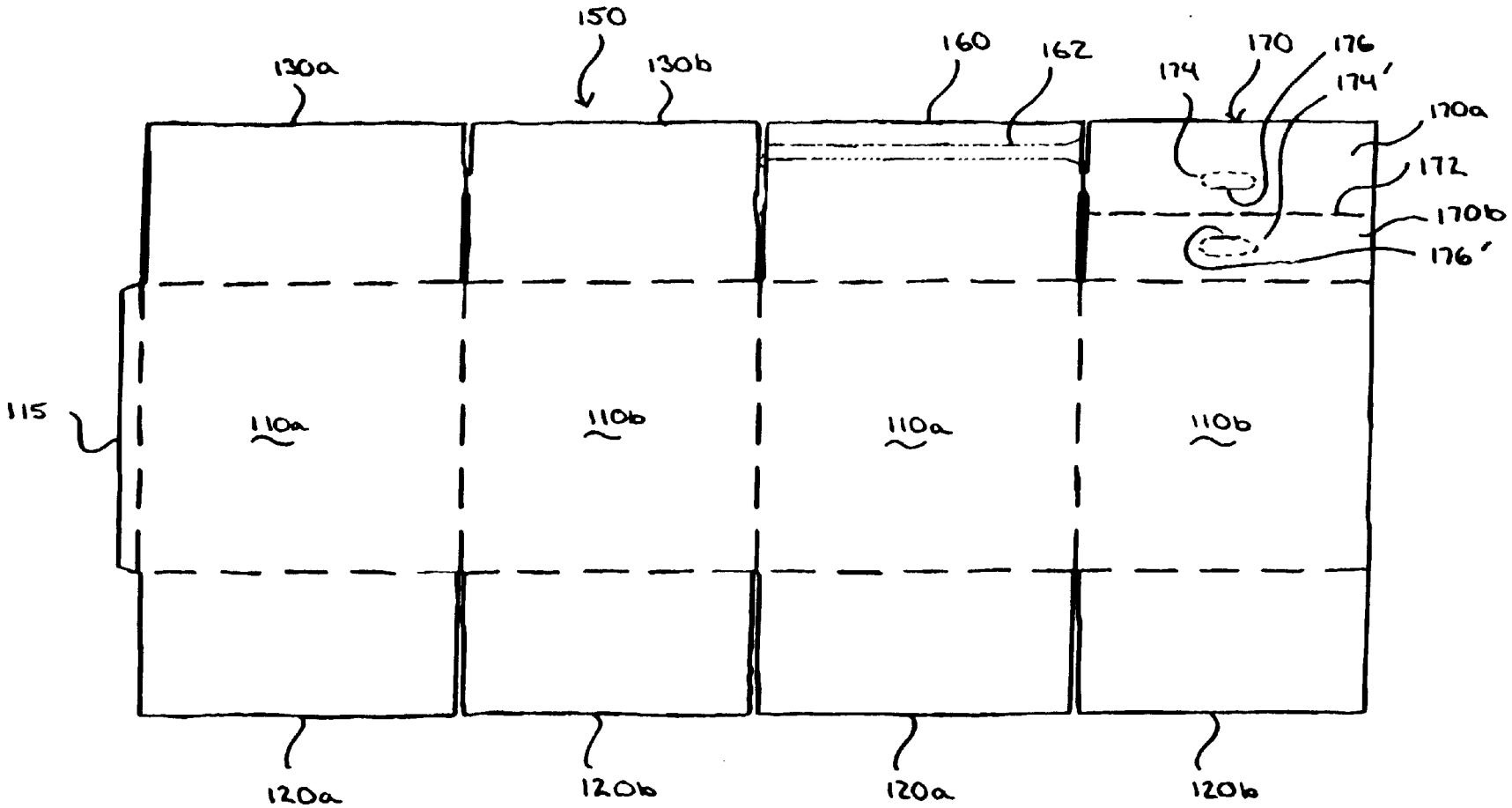
FIG. 26 is an unassembled outer casing equipped with a second embodiment of a hand-hold.

In another embodiment, depicted in FIG. 26, a substantially rectangular outer casing 150 may have four panels, e.g., two wider or length panels 110*a* and two narrower or width panels 110*b*, and a sealing tab 115. One of panels 110*a* and one of panels 110*b* is fitted with a pair of flaps 120*a* and 130*a* or 120*b* and 130*b*, respectively. One of panels 110*a*, however, is fitted with a first extended flap 160 that may be equipped with a perforated, tear strip or "zipper" 162, and one of panels 110*b* is fitted with a second extended flap 170 that may be scored along a seam 172, such that second extended flap 170 may be folded over upon itself. Moreover, second extended flap 170 may be equipped with two partially perforated openings 174 and 174'.

As with the previously described embodiment, when the outer casing is sealed, the uppermost flap preferably is the flap including the zipper. Thus, when outer casing 150 is sealed, first extended flap 160 with zipper 162 is the uppermost flap. Zipper 162 may be torn away to release second extended flap 170. Thereafter, second extended flap 170 may be folded over upon itself on the score of seam 172. The hand-hold may be formed in folded second extended flap 170 by mirrored sets of perforations 174 and 174' formed in each portion 170*a* and 170*b* of folded second extended flap 170. Each of these mirrored sets of perforations 174 and 174' extends substantially around the periphery of each hand-hold shape, but each hand-hold shape also is scored along mirrored seams 176 and 176' on the side of each hand-hold shape closest to the folded score on seam 172 in second extended flap 170. When extended flap material between each of perforations 174 and 174' is broken, the hand-hold shapes may be folded toward the folded score of seam 172 of second extended flap 170 to form a 4-ply hand-hold.

The temperature controlled container is substantially similar to the containers described above with respect to FIGS. 1–10. The container includes a lid and a base. Each of the lid and the base may have a thickness of at least about one inch, and preferably, in a range of about one inch to about two inches, and more preferably, in a range of about one inch to about 1.5 inches. For example, as noted above, the insulating material may be extruded polystyrene.

Preferably, the insulating material has may have an R value of at least about 0.0022 F°hr/Btu and a density in a range of about 1.35 to about 1.65 pounds per cubic foot, e.g., about 1.5 pounds per cubic foot.

The base comprises a base chamber including a plurality of channels formed on the interior of the base chamber. The lid comprises a first side for sealing the base chamber, which includes a plurality of channels formed in the first side, and a lid chamber divided into a plurality of food product receiving chambers. Sealing means are formed on the lid and on the base for sealing the base chamber, and cooling means are positioned within the temperature controlled container with respect to a plurality of food products to control the temperature within the temperature controlled container.

For example, the cooling means are selected from the group consisting of ice, dry ice packages, blue ice, frozen silicon gel packs, and thermally reactive chemical packs. If the cooling means are dry ice packages and the dry ice package is selected from the group consisting of a block of dry ice, dry ice pellets, and combinations thereof. Moreover, if the cooling means are dry ice packages, and the dry ice packages are wrapped in a mono layer of a copolymer blend comprising a LDPE and EVA. In addition, when the cooling means are dry ice packages, a gap, i.e., less than about 0.006 inches, is formed between the lid and the base through which gaseous $CO_2$ exits the temperature controlled container.

In a preferred embodiment of the system, the outer casing is fabricated from corrugated paper and has a thickness of about 0.25 inch; wherein the insulating material is expanded polystyrene and each of lid 1 and base 2 has a thickness of less than or equal to about 1.5 inches; wherein the temperature controlled container includes a plurality of individually packaged meals; and wherein the cooling means are dry ice packages, such that a ratio by weight of dry ice to the plurality of individually packaged meals is greater than 1:1, e.g., about 1.1:1. As noted above, the temperature controlled container may includes a plurality of layers of individually packaged meals, and the cooling means may be placed in various positions within the container in order to achieve the most effective and efficient temperature control within the container. For example, the cooling means may be positioned above all of the meals or under a first layer of individually packaged meals and above the remaining layers of individually packaged meals. Alternatively, the cooling means comprises a first cooling means and a second cooling means. The first cooling may be positioned above all of the meals or under the first layer of individually packaged meals and above the remaining layers of individually packaged meals. The second cooling means then may be positioned under the plurality of layers of individually packaged meals.

Recycling a Shipping and Storage Container

Figure 27:
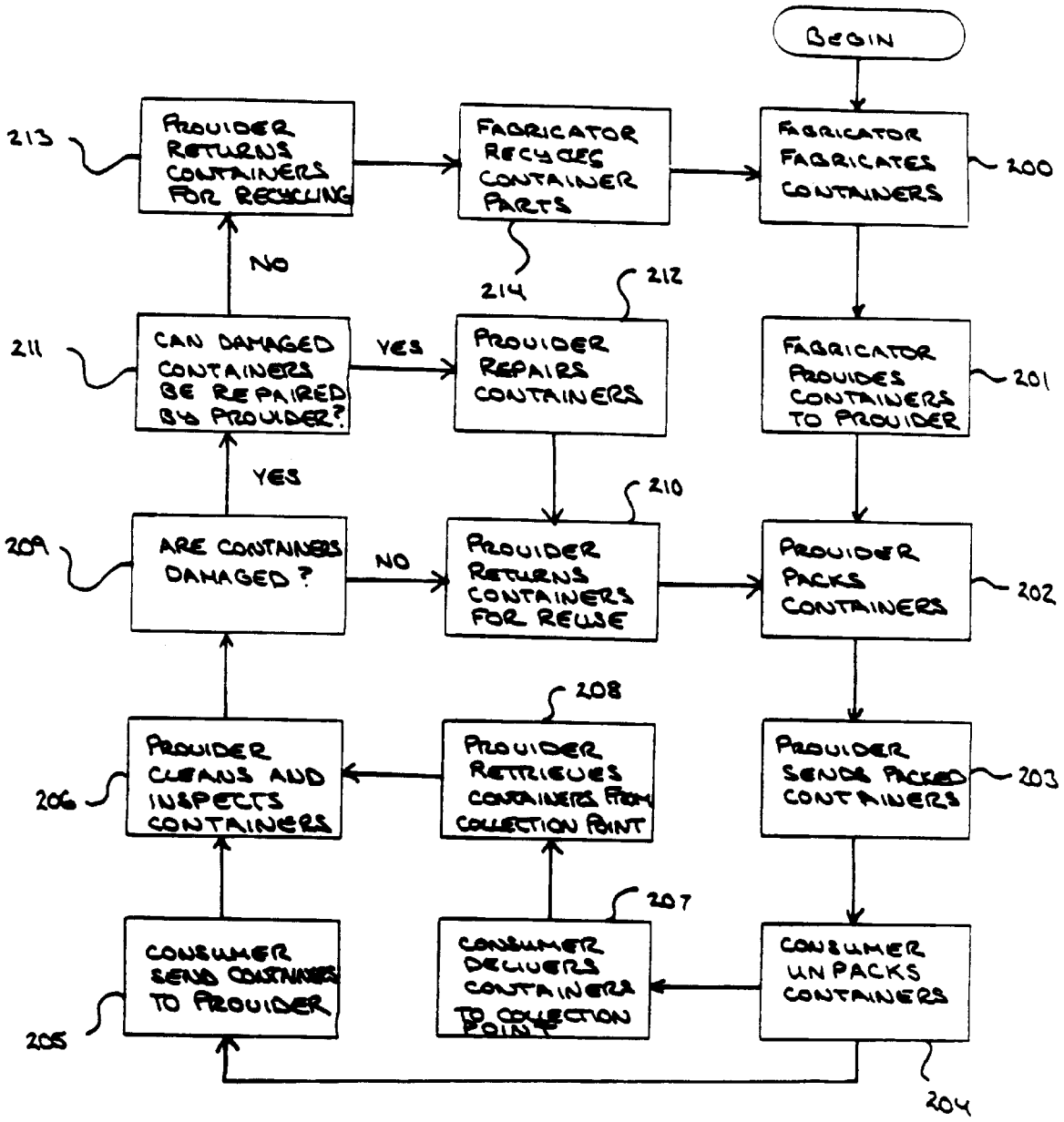
FIG. 27 is a flow chart depicting steps in a method for recycling shipping and storage containers in accordance with the invention.

Referring to FIG. 27, a method for recycling a shipping container comprises the steps of providing shipping containers to a provider of individually packaged meals from a shipping container fabricator (steps 200 and 201) and packing each of the shipping containers with a plurality of individually packaged meals and cooling means for controlling the temperature within the temperature controlled container (step 202). Each of the containers includes an outer casing enclosing a temperature controlled container fabricated from an insulating material. It further comprises the step of sending the shipping containers to at least one consumer or dieter (step 203). After removal of the plurality of individually packaged meals (step 204), the empty shipping containers are returned to the producer or provider of individually packaged meals (steps 205 and 207). The step of returning the empty shipping container may include sending the empty containers directly to the producer or provider by a parcel service, such as United Parcel Service (step 205). Alternatively, the step of returning the empty shipping container may include delivering the empty containers to a collection point (step 207) for collective retrieval by the producer or provider (step 208).

The provider cleans and inspects the returned shipping containers (step 206) and determines whether the containers are damaged (step 209). If the containers are not damaged, the provider returns the containers for reuse, e.g., repacking (step 210). If, however, the containers are damaged, the provider determines whether they can be repaired or refurbished, e.g., whether damaged parts, such as the lid, base or outer casing, may be replaced (step 211). If the damaged containers can be repaired or refurbished, the provider repairs or refurbishes the containers (step 212), and the provider returns the containers for reuse, e.g., repacking (step 210).

The provider returns damaged containers that the provider cannot repair or refurbish to the fabricator for recycling (step 213) and the fabricator recycles the container parts (step 214). The fabricator may use these recycled container parts to fabricate new containers (step 200). In addition, the provider may return container parts replaced during repair or refurbishment to the fabricator for recycling. Thus, the temperature controlled container may include an outer casing, a lid, and a base and the damaged portion is selected from the group consisting of the outer casing, the lid, and the base.

Shipping Frozen, Individually Packaged Meals

A process for shipping a plurality of frozen, individually packaged meals may comprise the steps of providing a shipping container, the containers including an outer casing enclosing a temperature controlled container fabricated from an insulating material and stabilizing a plurality of individually packaged meals at a temperature less than 0° C., e.g., at about −22° C. The plurality of stabilized, individually packaged meals then may be packed into the temperature controlled container and cooling means may be placed within the temperature controlled container.

For example, the cooling means are selected from the group consisting of ice, dry ice packages, blue ice, frozen silicon gel packs, and thermally reactive chemical packs. If the cooling means are dry ice packages and the dry ice package is selected from the group consisting of a block of dry ice, dry ice pellets, and combinations thereof. Moreover, if the cooling means are dry ice packages, and the dry ice packages are wrapped in a mono layer of a copolymer blend comprising a LDPE and EVA.

Figure 28:
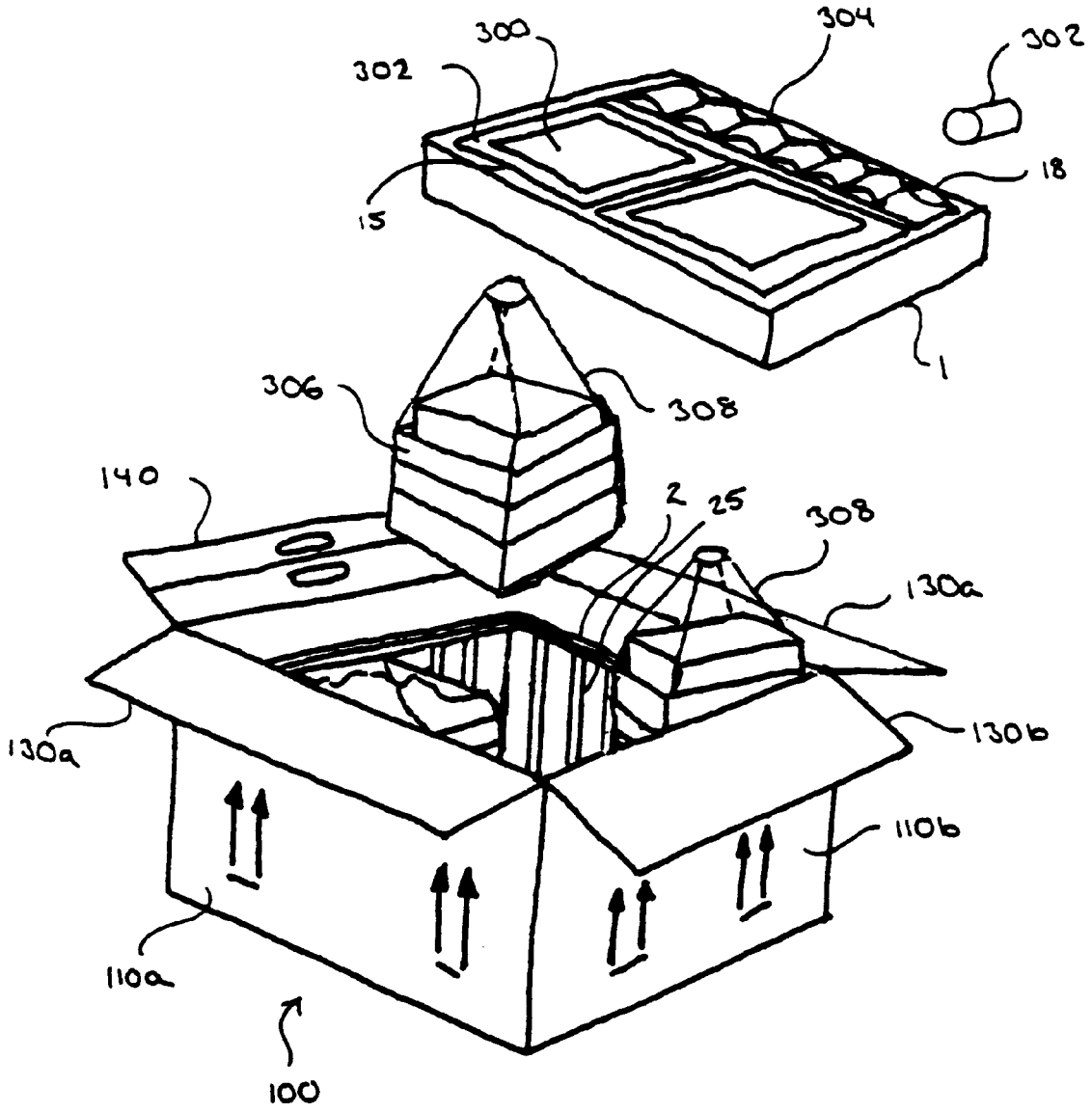
FIG. 28 is an exploded view of a shipping container including food products according to the present invention.

Referring to FIG. 28, the temperature controlled container comprises lid 1 and base 2, and after the temperature controlled container is packed, lid 1 and base 2 may be sealed together. Further, the temperature controlled container may be sealed within a liner. Alternatively, shelf stable food products 300 may be sealed within lid chamber 15 by a barrier 302, such as a sheet of polyethylene terephthalate. In addition, retorted food products 302, such as canned soups and stews, may be secured in can receptacles 18 of lid 1. Finally, the temperature controlled container may be sealed within outer casing 100 of corrugated paper.

The process for shipping a plurality of frozen, individually packaged meals also may include the step of stacking the plurality of individually packaged meals 306 in layers and positioning the cooling means under a first layer of individually packaged meals and above remaining layers of individually packaged meals. Alternatively, the plurality of individually packaged meals may be stacked in layers, and the cooling means comprises a first cooling means and a second cooling means, wherein the first cooling means are positioned under a first layer of individually packaged meals and above remaining layers of individually packaged meals and the second cooling means are positioned under the plurality of layers of individually packaged meals. In order to simplify the unpacking of the shipping container, when packed, the individually packaged meals may be segregated by type of meal, e.g., breakfast, lunch, or dinner, and each segregated group of the individually packaged meals may then be stacked and placed in a separate polymer bag 308, e.g., polyethylene, before loading into the temperature controlled container.

The invention may be more fully understood by consideration of the following examples, which are intended to be purely exemplary of the invention. Further, the unexpected results described above and revealed by the following examples are exemplary of the performance of embodiments of the present invention.

Examples

Tests were conducted to determine the ability of the container and the system of the present invention to ship and store food products without significant warming of those food products. For purposes of these tests, significant warming is an increase in the temperature of these food products above −12° C. Three different sizes of shipping and storage containers were prepared. The individually packaged meals were initially stabilized at −22° C. before being placed in the containers. Further, each of the containers had a two inch, base side wall thickness of insulating material, i.e., expanded polystyrene.

Figure 18A:
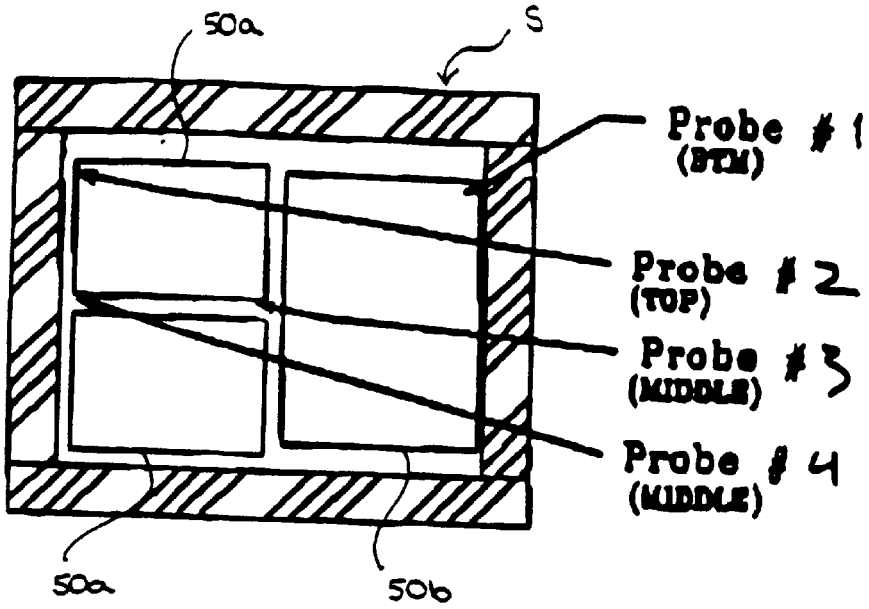
FIGS. 18*a* and 18*b* are schematic overhead and cross-sectional views, respectively, of a small shipping and storage container in accordance with the first embodiment of the invention.
Figure 18B:
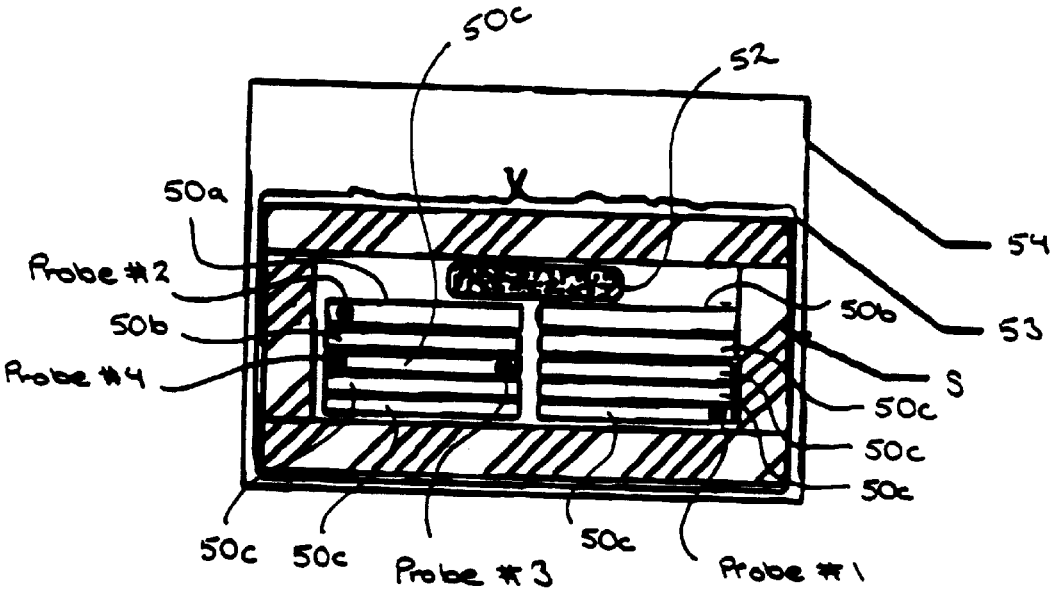

Referring to FIGS. 18*a* and 18*b,* schematic overhead and cross-sectional views, respectively, of the packing of a small shipping and storage container in accordance with a first embodiment of the invention are shown. The interior dimensions of the container were as follows: length=15.75 inches, width=12 inches, and depth=10 inches. The container included two individually packaged breakfast meals 50*a,* two individually packaged lunch meals 50*b,* and seven individually packaged dinner meals 50*c.* Moreover the cooling means for this container is one ten pound slab of dry ice. The dry ice was placed in a dry ice bag comprising a mono layer of a copolymer blend of LDPE and EVA.

FIG. 18*a* shows an overhead view of a container S. This schematic shows the positioning of the stacked meals 50*a* and 50*b.* In addition, it shows the approximate position of each of four temperature probes labeled Probe No. 1–4. These temperature probes were positioned, so that temperature could be analyzed at locations throughout container S. In addition, a fifth temperature probe was used to measure the ambient temperature and to record fluctuations in the ambient temperature.

Referring to FIG. 18*b,* with the exception of two breakfast meals 50*a* which are stacked side-by-side, as shown in FIG. 18*a,* lunch meals 50*b* and dinner meals 50*c* were stacked in two columns within container S. Further, FIG. 18*b* provides a somewhat more detailed depiction of the position of the probes. In addition, a single, ten pound slab of dry ice 52 was placed on top of the two columns of meals. Container S was then sealed and enclosed within a liner 53, e.g., a 2 mil plastic bag, and container S and liner 53 were then enclosed in an outer casing 54. The total weight of container S, meals 50*a–c,* and slab of dry ice 52 was about twenty-five pounds.

Figure 19:
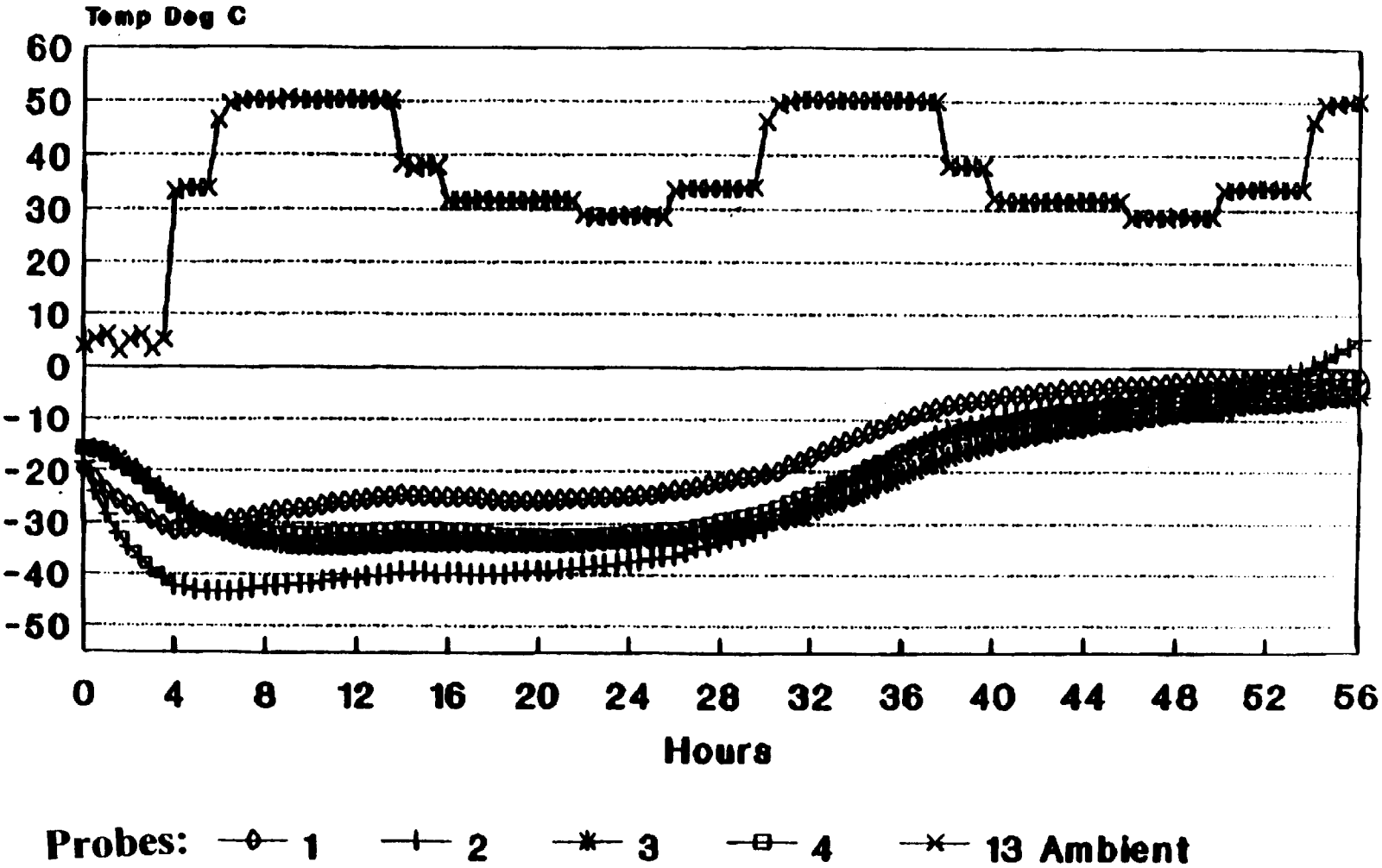
FIG. 19 is a chart showing the temperature variations within a temperature controlled container, over tine, at various temperature probes in the temperature controlled container of FIGS. 18*a* and 18*b;*

In FIG. 19, a chart is depicted showing the temperature variations at various temperature probes in the temperature controlled container of FIGS. 18*a* and 18*b.* As may be seen from FIG. 19, the food products remained below −12° C. for almost 36 hours despite fluctuations in the ambient temperature. The bottom-most Probe, i.e., probe No. 1, remained warmest throughout most of the test and began to record a significant temperature increase after about 36 hours.

Figure 20A:
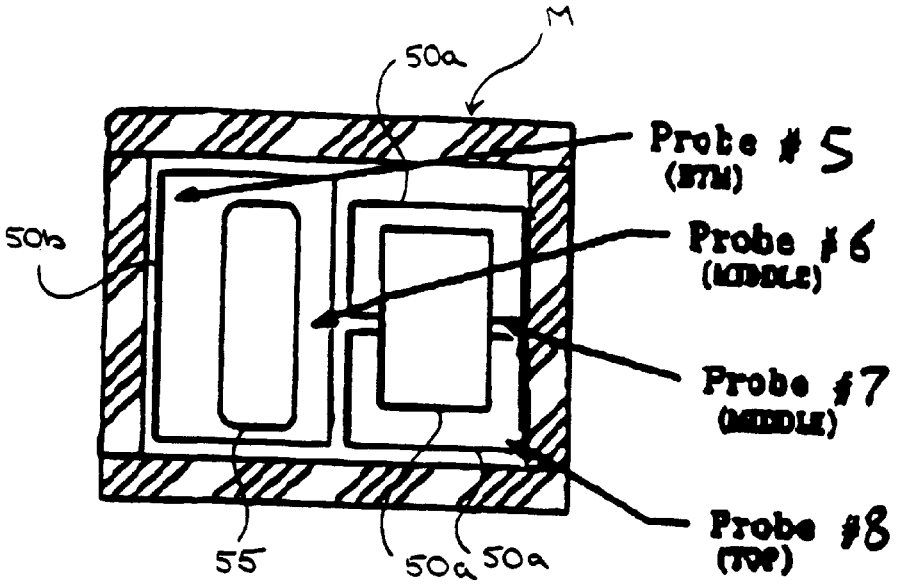
FIGS. 20*a* and 20*b* are schematic overhead and cross-sectional views, respectively, of the packing of a medium shipping and storage container in accordance with a first embodiment of the invention.
Figure 20B:
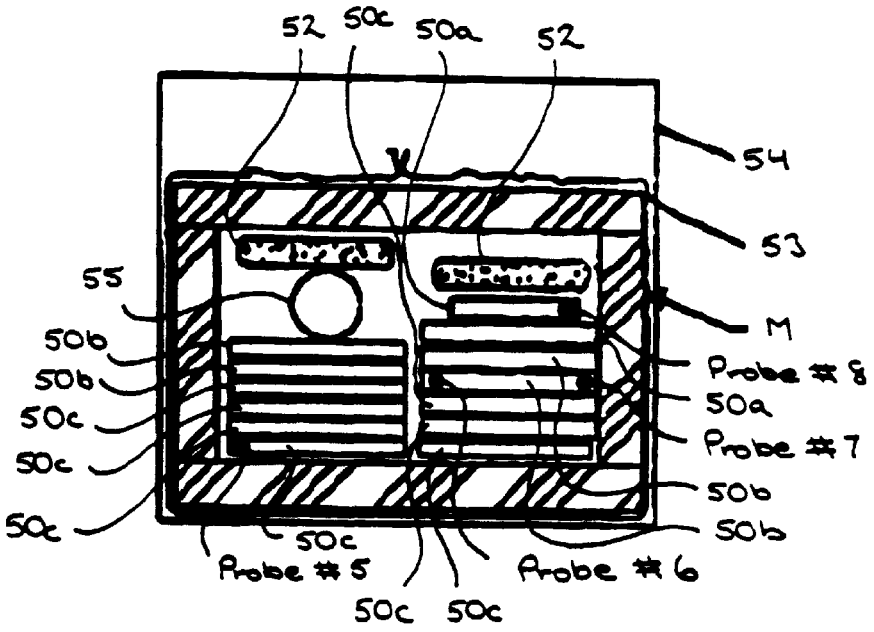

Referring to FIGS. 20*a* and 20*b,* schematic overhead and cross-sectional views, respectively, of the packing of a medium shipping and storage container in accordance with a first embodiment of the invention are shown. The interior dimensions of the container were as follows: length=15.75 inches, width=12 inches, and depth=13.5 inches. The container included three individually packaged breakfast meals 50*a,* four individually packaged lunch meals 50*b,* and seven individually packaged dinner meals 50*c.* Further, a bag of frozen bagels 55 was included. The bag for bagels 55 comprised a mono layer of LDPE. Moreover, the cooling means for this container was two approximately ten pound slabs of dry ice 52, i.e., one weighing about 11.8 pounds and the other weighing about 9.8 pounds. The dry ice again was placed in dry ice bags comprising a mono layer of a copolymer blend of LDPE and EVA.

FIG. 20*a* shows an overhead view of a container M. This schematic again shows the positioning of the stacked meals 50*a–c.* In addition, it shows the approximate position of each of four temperature probes labeled Probe Nos. 5–8. These temperature probes were positioned, so that temperature could be analyzed at locations throughout container M. In addition, a fifth temperature probe again was used to measure the ambient temperature and to record fluctuations in the ambient temperature.

Referring to FIG. 20*b,* with the exception of three breakfast meals 50*a,* two of which are stacked side-by-side and one stacked athwart the two meals 50*a,* as shown in FIG. 20*a,* lunch meals 50*b* and dinner meals 50*c* were stacked in two columns within container M and a bag of frozen bagels also was included in container M. Further, FIG. 20*b* provides a somewhat more detailed depiction of the position of the probes. In addition, two slabs of dry ice 52 ware placed on top of the two columns of meals. Container M was then sealed and enclosed within a liner 53, e.g., a 2 mil plastic bag, and container M and liner 53 were then enclosed in an outer casing 54. The total weight of container M, meals 50*a–c,* bag of bagels 55, and slabs of dry ice 52 was about thirty-nine pounds.

Figure 21:
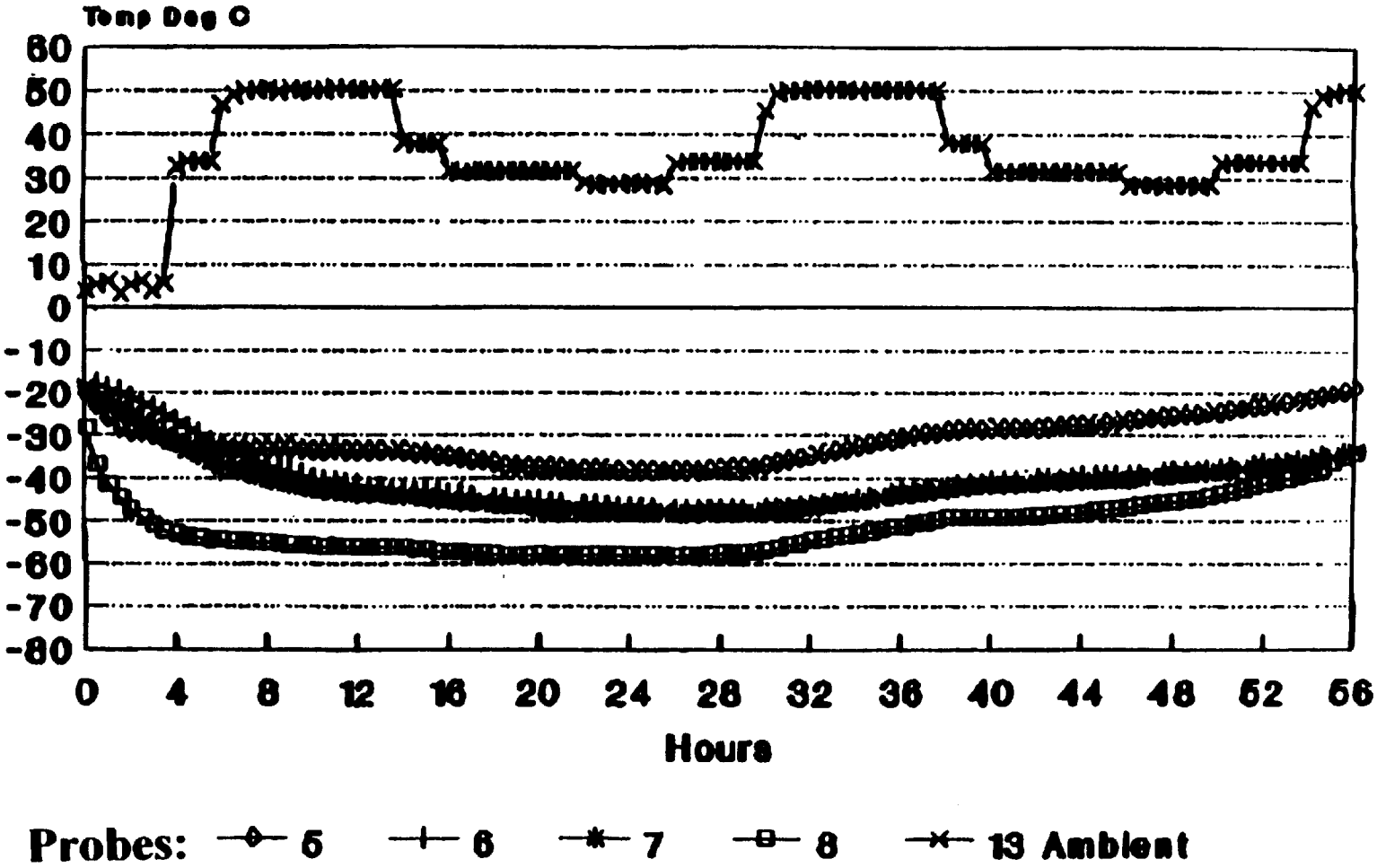
FIG. 21 is a chart showing the temperature variations within a temperature controlled container, over time, at various temperature probes in the temperature controlled container of FIGS. 20*a* and 20*b;*

In FIG. 21, a chart is depicted showing the temperature variations at various temperature probes in the temperature controlled container of FIGS. 20*a* and 20*b.* As may be seen from FIG. 21, the food products remained below −12° C. for almost 56 hours despite broad fluctuations in the ambient temperature. Although the bottom-most probe, i.e., Probe No. 5, remained warmest throughout most of the test, all of the probe temperature readings remained acceptable throughout the test.

Figure 22A:
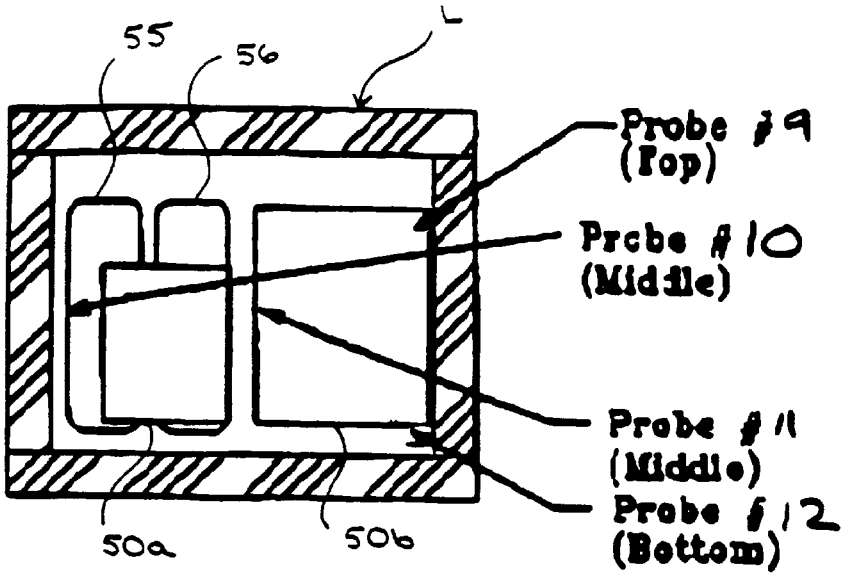
FIGS. 22*a* and 22*b* are schematic overhead and cross-sectional views, respectively, of the packing of a large shipping and storage container in accordance with a first embodiment of the invention.
Figure 22B:
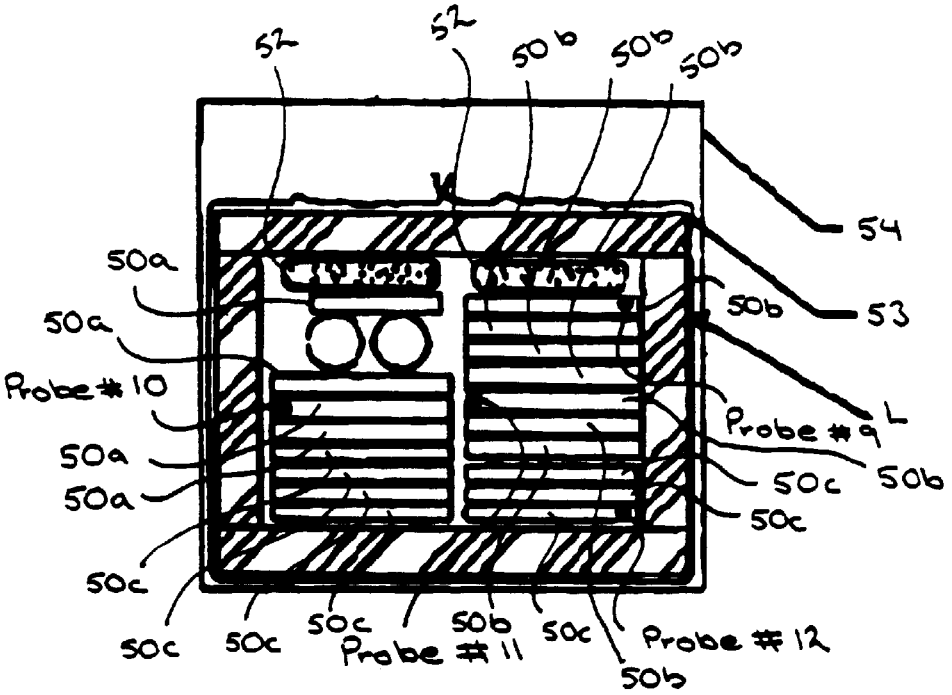

Referring to FIGS. 22*a* and 22*b,* schematic overhead and cross-sectional views, respectively, of the packing of a large shipping and storage container in accordance with a first embodiment of the invention are shown. The interior dimensions of the container were as follows: length=15.75 inches, width=12 inches, and depth=17 inches. The container included seven individually packaged breakfast meals 50*a,* seven individually packaged lunch meals 50*b,* and seven individually packaged dinner meals 50*c.* Further, a bag of frozen bagels 55 and a bag of frozen pretzels 56 was included. The bags for bagels 55 and pretzels 56 comprised a mono layer of LDPE. Moreover, the cooling means for this container was two approximately ten pound slabs of dry ice 52, i.e., one weighing about 10.5 pounds and the other weighing about 10.4 pounds. The dry ice again was placed in dry ice bags comprising a mono layer of a copolymer blend of LDPE and EVA.

FIG. 22*a* shows an overhead view of a container L. This schematic again shows the positioning of the stacked meals 50*a–c*. In addition, it shows the approximate position of each of four temperature probes labeled Probe Nos. 9–12. These temperature probes were positioned, so that temperature could be analyzed at locations throughout container L. In addition, a fifth temperature probe again was used to measure the ambient temperature and to record fluctuations in the ambient temperature.

Referring to FIG. 22*b,* with the exception of seven breakfast meals 50*a,* six of which are stacked side-by-side and one stacked athwart the six stacked meals 50*a,* as shown in FIG. 22*a,* lunch meals 50*b* and dinner meals 50*c* were stacked in two columns within container L. Further, FIG. 22*b* provides a somewhat more detailed depiction of the position of the probes. In addition, two slabs of dry ice 52 ware placed on top of the two columns of meals. Container L was then sealed and enclosed within a liner 53, e.g., a 2 mil plastic bag, and container L and liner 53 were then enclosed in an outer casing 54. The total weight of container 1, meals 50*a–c,* bag of bagels 55, bag of pretzels 56, and slabs of dry ice 52 was about forty-five pounds.

Figure 23:
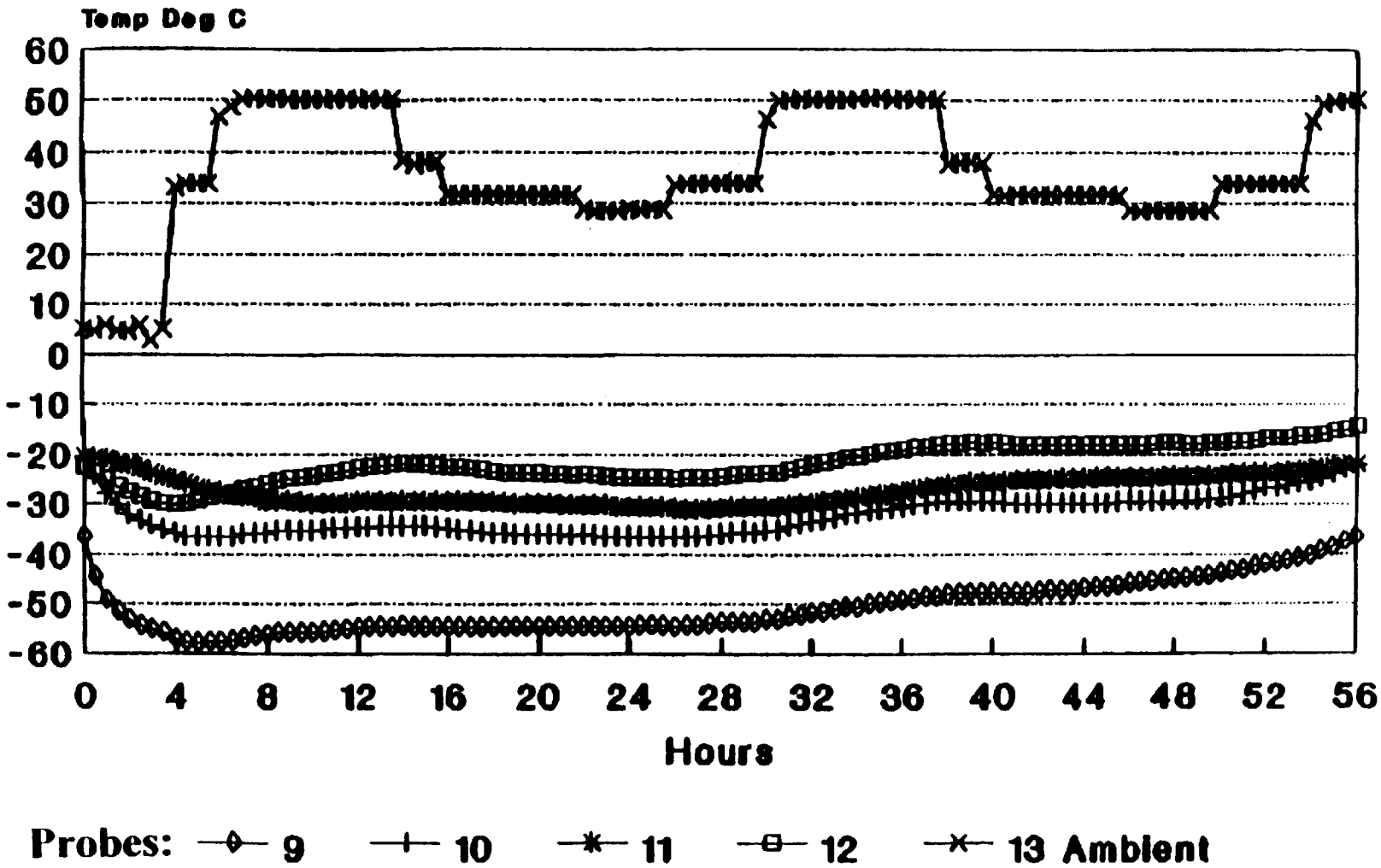
FIG. 23 is a chart showing the temperature variations within a temperature controlled container, over time, at various temperature probes in the temperature controlled container of FIGS. 22*a* and 22*b;*

In FIG. 23, a chart is depicted showing the temperature variations at various temperature probes in the temperature controlled container of FIGS. 22*a* and 22*b.* As may be seen from FIG. 23, the food products remained below −12° C. for almost 56 hours despite broad fluctuations in the ambient temperature. The bottom-most probe, i.e., Probe No. 12, remained warmest throughout most of the test, but again all of the probe temperature readings remained acceptable throughout the test.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and examples be considered as exemplary only, with the true scope and spirit of the invention being indicated by the following claims.

We claim:

1. A container for shipping and storing food products in a plurality of chambers, comprising a temperature controlled container fabricated from an insulating material, including a lid and a base;

said base comprising a base chamber including a plurality of channels formed on the interior of said base chamber;

said lid comprising a first side for sealing said base chamber, which includes a plurality of channels formed in said first side, and a lid chamber;

sealing means formed on said lid and on said base for sealing said base chamber.

2. The container of claim 1, wherein an outer casing encloses said temperature controlled container.

3. The container of claim 2, wherein said outer casing is fabricated from corrugated paper.

4. The container of claim 3, wherein said outer casing has a thickness of about 0.25 inch.

5. The container of claim 4, wherein said outer casing has an R value of at least 0.0005 F°hr/Btu.

6. The container of claim 2, wherein said outer casing includes a liner surrounding said insulated container.

7. The container of claim 1, wherein said lid chamber is divided into a plurality of food product receiving chambers.

8. The container of claim 1, wherein said insulating material is extruded polystyrene.

9. The container of claim 1, wherein said insulating material has an R value of at least 0.0022 F°hr/Btu.

10. The container of claim 8, wherein said insulating material has a density in a range of about 1.35 to about 1.65 pounds per cubic foot.

11. The container of claim 8, wherein said insulating material has a density of about 1.5 pounds per cubic foot.

12. The container of claim 1, wherein said sealing means comprises a lip formed on said base and a corresponding groove formed on said lid, such that said lip interlocks with said groove.

13. The container of claim 1, wherein each of said lid and said base has a thickness of at least one inch.

14. The container of claim 1, wherein each of said lid and said base has a thickness in a range of about one inch to about 1.5 inches.

15. The container of claim 1, wherein a gap is formed between said lid and said base in a range of less than about 0.006 inches.

16. The container of claim 1, wherein each of said lid and said base are molded from said insulating material.

17. The container of claim 1, wherein each of said lid and said base are constructed from individual slabs of said insulating material.

18. The container of claim 1, wherein said plurality of food product receiving chambers includes a plurality of semi-cylindrical chambers for receiving canned food products.

19. The container of claim 1, wherein said plurality of food product receiving chambers includes a plurality of substantially rectangular chambers for receiving packaged food products.

20. The container of claim 1, wherein said plurality of food product receiving chambers includes a plurality of semi-cylindrical chambers and a plurality of substantially rectangular chambers.

21. A container for shipping and storing food products in a plurality of chambers, comprising an outer casing enclosing a temperature controlled container fabricated from an insulating material, including a lid and a base;

said base comprises a bottom portion and at least one base side wall having an upper base side wall edge and a lower, base side wall edge, whereby said lower, base side wall edge of said at least one base side wall is affixed to said floor portion to form a fluid tight seal between said at least one base side wall and said bottom portion, thereby forming a base chamber;

said base chamber includes a plurality of channels formed in said at least one side wall and a plurality of channels formed in said floor portion;

said lid comprises a top portion having a first side for sealing said base chamber and at least one lid side wall having an upper, lid side wall edge and a lower, lid side wall edge whereby said lower, lid side wall edge of said at least one lid side wall is affixed to said top portion to form a fluid tight seal between said at least one base lid wall and said top portion, thereby forming a lid chamber;

said lid chamber includes a plurality of partitions affixed to a second side of said top portion, which divide said lid chamber into a plurality of food product receiving chambers;

said top portion having a plurality of channels formed in said first side of said top portion; and sealing means formed on said lid and on said upper, base side wall edge for sealing said base chamber.

22. The container of claim 21, wherein said outer casing is fabricated from corrugated paper.

23. The container of claim 22, wherein said outer casing has a thickness of about 0.25 inch.

24. The container of claim 23, wherein said outer casing has an R value of at least about 0.0005 F°hr/Btu.

25. The container of claim 24, wherein said outer casing includes a liner surrounding said insulated container.

26. The container of claim 21, wherein said insulating material is extruded polystyrene.

27. The container of claim 21, wherein said insulating material has an R value of at least 0.0022 F°hr/Btu.

28. The container of claim 26, wherein said insulating material has a density in a range of about 1.35 to about 1.65 pounds per cubic foot.

29. The container of claim 26, wherein said insulating material has a density of about 1.5 pounds per cubic foot.

30. The container of claim 21, wherein said sealing means comprises a lip formed on said upper, base side wall edge and a corresponding groove formed on said lid, such that said lip interlocks with said groove.

31. The container of claim 21, wherein each of said lid and said base has a thickness of at least one inch.

32. The container of claim 21, wherein each of said side walls and said top and bottom portions has a thickness in a range of about one inch to about 1.5 inches.

33. The container of claim 21, wherein a gap is formed between said lid and said base in a range of less than about 0.006 inches.

34. The container of claim 21, wherein each of said lid and said base are constructed from individual slabs of said insulating material.

35. A system for shipping and storing food products in a plurality of chambers, comprising:

a container including:

an outer casing enclosing a temperature controlled container fabricated from an insulating material, including a lid and a base;

said base comprises a base chamber including a plurality of channels formed on the interior of said base chamber;

said lid comprises a first side for sealing said base chamber, which includes a plurality of channels formed in said first side, and a lid chamber divided into a plurality of food product receiving chambers;

sealing means formed on said lid and on said base for sealing said base chamber; and cooling means positioned within said temperature controlled container with respect to a plurality of food products to control the temperature within said temperature controlled container.

36. The system of claim 35, wherein said outer casing is fabricated from corrugated paper.

37. The system of claim 36, wherein said outer casing has a thickness of about 0.25 inch.

38. The system of claim 37, wherein said outer casing has an R value of at least 0.0005 F°hr/Btu.

39. The system of claim 35, wherein said outer casing includes a liner surrounding said insulated container.

40. The system of claim 35, wherein said insulating material is extruded polystyrene.

41. The system of claim 40, wherein said insulating material has a density in a range of about 1.35 to about 1.65 pounds per cubic foot.

42. The system of claim 40, wherein said insulating material has a density of about 1.5 pounds per cubic foot.

43. The system of claim 35, wherein said insulating material has an R value of at least 0.0022 F°hr/Btu.

44. The system of claim 35, wherein said sealing means comprises a lip formed on said base and a corresponding groove formed on said lid, such that said lip interlocks with said groove.

45. The system of claim 35, wherein each of said lid and said base has a thickness of at least one inch.

46. The system of claim 35, wherein each of said lid and said base has a thickness in a range of about one inch to about 1.5 inches.

47. The system of claim 35, wherein a gap is formed between said lid and said base in a range of less than about 0.006 inches.

48. The system of claim 35, wherein each of said lid and said base are molded from said insulating material.

49. The system of claim 35, wherein each of said lid and said base are constructed from individual slabs of said insulating material.

50. The system of claim 35, wherein said plurality of food product receiving chambers includes a plurality of semi-cylindrical chambers for receiving canned food products.

51. The system of claim 35, wherein said plurality of food product receiving chambers includes a plurality of substantially rectangular chambers for receiving packaged food products.

52. The system of claim 35, wherein said plurality of food product receiving chambers includes a plurality of semi-cylindrical chambers and a plurality of substantially rectangular chambers.

53. The system of claim 35, wherein said cooling means are selected from the group consisting of ice, dry ice packages, blue ice, frozen silicon gel packs, and thermally reactive chemical packs.

54. The system of claim 35, wherein said cooling means are dry ice packages and a gap is formed between said lid and said base through which gaseous $CO_2$ exits said temperature controlled container.

55. The system of claim 35, wherein said outer casing is sealed with stretch wrap.

56. The system of claim 35, wherein said outer casing is sealed with bands.

57. The system of claim 35, wherein said cooling means are dry ice packages and said dry ice packages are wrapped in a mono layer of a copolymer blend comprising a low density polyethylene and ethyl vinyl acetate.

58. The system of claim 35, wherein said cooling means are dry ice packages and said dry ice package is selected from the group consisting of a block of dry ice, dry ice pellets, and combinations thereof.

59. The system of claim 35, wherein said temperature controlled container includes a plurality of layers of individually packaged meals and said cooling means are positioned under the first layer of individually packaged meals and above the remaining layers of individually packaged meals.

60. The system of claim 35, wherein said temperature controlled container includes a plurality of layers of individually packaged meals and said cooling means comprises a first cooling means and a second cooling means, wherein said-first cooling means are positioned under the first layer of individually packaged meals and above the remaining layers of individually packaged meals and said second cooling means are positioned under said plurality of layers of individually packaged meals.

61. The system of claim 35, wherein said outer casing is fabricated from corrugated paper and has a thickness of about 0.25 inch; wherein said insulating material is expanded polystyrene and each of said lid and said base has a thickness of less than or equal to about 1.5 inches; wherein said temperature controlled container includes a plurality of individually packaged meals; and wherein said cooling means are dry ice packages, such that a ratio by weight of dry ice to said plurality of individually packaged meals is about 1.1:1.

* * * * *